US007178318B2

(12) United States Patent
Swain

(10) Patent No.: US 7,178,318 B2
(45) Date of Patent: Feb. 20, 2007

(54) SADDLE TREE INCLUDING A PROGRESSIVE FLEX HEADPLATE ASSEMBLY

(75) Inventor: Barrie P. Swain, Walsall (GB)

(73) Assignee: Mondial Industries Ltd, Hudson, OH (US)

( * ) Notice: Subject to any disclaimer, the term of this patent is extended or adjusted under 35 U.S.C. 154(b) by 281 days.

(21) Appl. No.: 10/712,745

(22) Filed: Nov. 13, 2003

(65) Prior Publication Data

US 2005/0120683 A1 Jun. 9, 2005

(51) Int. Cl.
*B68C 1/02* (2006.01)

(52) U.S. Cl. ..... 54/44.7; 54/44.1

(58) Field of Classification Search ..... 54/44.1, 54/44.4, 44.7

See application file for complete search history.

(56) References Cited

U.S. PATENT DOCUMENTS

| | | | | |
|---|---|---|---|---|
| 303,152 | A | 8/1884 | Hahn | |
| 542,940 | A * | 7/1895 | Padgitt | 54/44.1 |
| 564,976 | A | 8/1896 | Dersch | |
| 1,154,003 | A | 9/1915 | Downing | |
| 1,246,675 | A | 11/1917 | Stewart | |
| 2,208,303 | A | 7/1940 | Frueh | |
| 3,286,440 | A * | 11/1966 | Walker et al. | 54/44.7 |
| 3,712,024 | A * | 1/1973 | Nankivell | 54/44.7 |
| 3,740,792 | A | 6/1973 | Werner | |
| 3,835,621 | A | 9/1974 | Gorenschek | |
| 4,765,126 | A | 8/1988 | Bates | |
| 4,965,988 | A | 10/1990 | Anderson et al. | |
| 4,996,827 | A | 3/1991 | Pellew | |
| 5,175,986 | A | 1/1993 | Farley | |
| 5,517,808 | A | 5/1996 | Schleese | |
| 6,263,647 | B1 | 7/2001 | Walkley | |
| 6,363,698 | B1 | 4/2002 | Swain | |
| 6,370,849 | B1 | 4/2002 | Merker | |
| 6,484,480 | B2 | 11/2002 | Rauch | |
| 6,523,332 | B1 | 2/2003 | Erb | |

FOREIGN PATENT DOCUMENTS

| | | |
|---|---|---|
| FR | 358771 | 3/1906 |
| FR | 393882 | 1/1909 |
| GB | 191505771 | 8/1915 |

* cited by examiner

*Primary Examiner*—Robert P. Swiatek
(74) *Attorney, Agent, or Firm*—Reinhart Boerner Van Deuren S.C.

(57) ABSTRACT

A saddle tree including a progressive flex headplate, and a saddle constructed therewith, which are capable for properly fining a variety of different size horses. The headplate assembly is constructed of a plurality of flexible, and resilient overlapping layers which increase in length from top to bottom and which are secured together at the center point of the layers. The configuration supplies the headplate assembly with non-linear resistance, permitting progressive flexure of the legs of the headplate assembly while providing resistance in response to flexure of each leg, providing the headplate assembly with points that flex to properly fit horses of varying widths.

26 Claims, 9 Drawing Sheets

SADDLE TREE INCLUDING A PROGRESSIVE FLEX HEADPLATE ASSEMBLY

BACKGROUND OF THE INVENTION

Field of the Invention

The present invention relates generally to saddle trees, and more particularly to a novel construction for a saddle tree system including a progressive flex headplate assembly which permits the saddle tree, and thus the saddle, to properly and comfortably fit a horse regardless shape, weight, or range of movement, but also to accommodate horses of varying sizes.

While some minor variations exist, the basic construction of a riding saddle for horses has remained virtually unchanged for the last century. Certainly, the fundamental mechanics and purpose of the saddle have remained consistent. For instance, a saddle must provide a secure seat for the rider, without inhibiting the movement of the horse's shoulder blades. A saddle must remove weight from the horse's spine and loins and distribute it evenly over the remaining area of the horse's back. A saddle must also provide a secure anchor for the stirrups.

The heart of any saddle is the saddle tree, which provides the structural framework from which the saddle is constructed. The saddle tree provides the shape of the saddle seat, determines the saddle fit for the horse, and is the main component to which all other saddle components and fittings are attached. Importantly, the saddle tree protects a horse's spine from the pressure exerted by the weight of the rider and the saddle.

The main elements of the saddle tree include a pommel portion, a cantle portion, and the bars or connecting portion therebetween. In a Western saddle, a horn, which the rider may grasp while riding, is also typically included as part of the saddle tree, and is attached to the pommel portion.

The pommel portion is located at the front of the saddle tree and provides shape and fit to the front of the completed saddle. In use, the pommel portion is situated towards the front of the horse. The pommel portion includes a reinforcing headplate and gullet plate that are typically in the shape of an inverted U. The legs of the U (called the "points" of the headplate or pommel portion) extend downwardly on each side of the horse's withers. The points of the saddle tree determine the saddle's width, and thus, are probably the most important aspect in evaluating a saddle's suitability for a particular horse. If the width of the saddle tree is not correct, the saddle does not fit. Accordingly, when fitted properly, the points of the headplate run parallel to the horse's withers.

The cantle portion is located at the back of the saddle tree and provides shape and definition to the seat back of the completed saddle. In use, the cantle portion will be situated towards the rear of the horse. The cantle portion is also configured in the shape of an inverted U, and serves as a back rest to keep the rider from slipping off the back of the horse. The bars (or connectors) connect the pommel portion to the cantle portion from front to back along both sides of the horse's spine.

The components of a saddle tree are commonly constructed of wood, resin bonded plywood laminates, metal, plastic, fiberglass, or composites thereof. The saddle tree is covered with leather, and other saddle components, such as a seat cover, stirrups, cinch straps, etc., are added to form the completed saddle.

Because the saddle tree makes up the main structural framework of a saddle, the saddle tree must properly fit the horse for which it is intended. An improperly fitted or designed saddle tree, when used in a conjunction with a saddle, can result in the horse's skin not receiving sufficient blood flow which reduces the ability of the skin to sweat. If this situation continues for a long period of time, it can result in hair loss, sore back, and possible muscle damage to the horse. Indeed, an improperly fitted saddle tree can over time cause severe injuries to the spine and/or shoulders of the horse, and can prevent a rider from having a safe and secure ride.

Moreover, an uncomfortable horse, or a horse in pain, will not perform the way the rider or trainer expects. In addition, an improperly fitted saddle may slip or slide forward, catching the rider off guard, restricting the movement of the horse, and compounding injury to the horse's neck or spine.

A traditional saddle tree is rigid, having a solid, stiff structure. Because the shape of a horse's back changes and flexes as it moves, a rigid saddle tree which does not flex with the horse digs into the horse's shoulders and places excessive pressure on the horse's kidneys. In addition, a rigid saddle tree does not permit the weight of the rider to be distributed over the large area on either side of the horse's spine along the horse's back. Rather, a rigid saddle tree causes pain at very distinct points on the withers and scapula at the front of the horse, and on the loins at the rear of the horse.

More recently, "spring" saddle trees and "flexible" saddle trees have been developed with an eye toward improved fit and comfort for the horse. These saddle trees contain flexible steel or resilient bars (denoted "springs") which connect the pommel portion and the cantle portion and reinforce the strength of the saddle tree while also providing flexibility when the horse moves. These trees are still substantially rigid, and thus can only be designed to accommodate one horse.

While newer saddle tree designs focus on the initial saddle fit on a horse, few designs focus on the proper dynamic fit of a saddle tree as the horse moves while being ridden. In fact, the weight of the rider in combination with the movement of the horse can result in a saddle that, while appearing to be properly fitted initially, is actually a poor fit and causes the horse pain during the ride.

In addition, most saddle trees, even if encompassing springs or flexible bars, are designed to fit only one horse, and are constructed in only narrow, medium, or wide (one-fit fits many) sizes. Because the pommel portion (which includes the headplate and the points) remains rigid in these designs, this type of saddle tree is not accommodating to either the change in shape of the horse during movement of the horse, or horses of varying size.

When the headplate is inappropriate in width for the particular horse, the saddle tree will not only cause pain to the horse, but can cause damage to the saddle tree, shortening the useful life of the saddle. In particular, a headplate that is too narrow will impede the horse's movement dramatically and caused observable soreness to the spine of the horse.

The points of the saddle tree should lie parallel to the withers, instead of sitting on top of the musculature. However, if the angles of the points are too narrow, the points will dig into the musculature and shoulders of the horse, also causing the middle of the saddle to be in uneven contact with the horse's back. If the angles are too wide, the saddle will tip forward or sit down too far in front of the horse which can cause pinching, or can put undue pressure on top of the withers and on the spine.

Therefore, it would be highly desirable to have a headplate and saddle tree system for use in a riding saddle that properly and comfortably fits a horse throughout the horse's range of motion, and which evenly distributes the weight of the rider across the horse so as to prevent injury and irritation to the horse. In addition, it would be desirable to have a saddle that can be properly fit onto more than one size horse, thereby minimizing the need for multiple different saddles each fit for a particular horse.

It is accordingly the primary objective of the present invention to provide a headplate assembly for use in a saddle tree which permits progressive flex of the headplate points in order to permit minor adjustments of the width of the pommel portion of a saddle tree. It is a related objective of the present invention to provide a headplate that properly and securely fits a horse by providing a progressively flexible point construction that is resilient but also provides resistance in response to flexure—with the flex of the point construction progressively increasing down the length of the headplate assembly. It is yet another objective of the present invention to provide a headplate assembly including progressively flexible point construction which still provides sufficient rigidity to support the weight of the saddle and the weight of the rider without deformation of the headplate.

It is another objective of the present invention to provide a saddle tree including a progressive flex headplate construction that permits the saddle tree to flex with the movement of the horse while also providing sufficient resistance to maintain the saddle tree in the proper position on the horse. Accordingly, it is a related objective of the present invention to provide a saddle tree that provides a proper fitting headplate and points construction that will not cause injury or soreness to the horse. It is yet another objective of the present invention to provide a saddle tree capable of properly and securing fitting horses of varying size.

It is still another objective of the present invention to provide a riding saddle including a saddle tree having a progressive flex headplate assembly. The saddle of the present invention must maintain a proper and secure fit under the weight of the rider while permitting full range of motion of the horse, without causing injury or soreness to the horse's neck, spine or loins.

The headplate and saddle tree assembly of the present invention must also be of construction which is both durable and long lasting, and it should also require little or no maintenance to be provided by the user throughout its operating lifetime. In order to enhance the market appeal of the headplate and saddle tree construction of the present invention, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

The disadvantages and limitations of the background art discussed above are overcome by the present invention. With this invention, a saddle tree including progressive flex headplate assembly for use in a flexible riding saddle is provided.

The progressive flex saddle tree of the present invention includes a progressive flex headplate assembly located at the pommel portion of the saddle tree, which is located at the front of the saddle tree, towards the withers the horse. The saddle tree also includes a cantle, which is located at the back of the saddle tree towards the rear of the horse, and a connecting portion which connects the headplate assembly to the cantle.

The progressive flex headplate assembly of the present invention is configured in the shaped of an inverted V, with the apex of the V being rounded. The headplate assembly contains two legs that extend downwardly on opposite sides of the horse's withers. The ends of each leg of the headplate assembly are referred to herein as the points of the headplate assembly. The location of the points of the headplate assembly determine the size of the saddle tree, and thus the points are important to determining the proper fit of a saddle.

The headplate assembly is of multi-layered construction, and in one embodiment includes a bottom layer, a middle layer, and a top layer of narrow, flexible segments. Each of the layers differs from each the others both in length and in the width their respective ends. The layers are arranged overlaying each other so that each layer becomes increasing longer from the top layer to the bottom layer. As such, the bottom layer is the longest layer, the middle layer is the intermediate length layer, and the top layer is the shortest layer.

Each layer is provided with a small indentation in its front edge corresponding to the pommel portion of the headplate assembly. Each layer is also provided with apertures for securing the layers together to complete the headplate assembly and for securing the headplate assembly to the completed saddle tree.

Each of the layers may be constructed of nylon, vinyl, polyethylene, polystyrene, polypropylene, polyvinyl chloride, or any similar flexible yet resilient material. Alternatively, the layers may be constructed of steel, or another metal or composite material exhibiting the flexibility and resilience required for the headplate assembly.

The headplate assembly also includes a headplate centerpiece, which is a rigid, curved segment that also contains apertures for securing the headplate assembly together. The headplate centerpiece is constructed of a rigid material in order to provide the structure to the pommel portion of the headplate assembly. Accordingly, the headplate centerpiece may be made of materials such as wood, metal (e.g. steel or iron), rigid thermoplastic or polymer material, and/or composites thereof that provide a rigid structure to the headplate assembly.

The headplate assembly of the present invention is constructed by arranging the top, middle, and bottom layers overlaying each other, starting with the longest layer on the bottom, with the intermediate length layer as the middle layer, overlying the bottom layer, and with the shortest layer as the top layer, overlying the middle layer. The headplate centerpiece is then positioned overlying the top layer, with the apertures in the headplate centerpiece being aligned with the securing apertures in each of the three layers. In one alternate embodiment of the present invention, the headplate centerpiece, rather than being positioned overlaying the top layer, is positioned overlaying the bottom layer with the apertures in the headplate centerpiece again being aligned with the securing apertures in each of the layers.

The headplate assembly is secured together using a series of rivets which pass through the aligned apertures in the headplate centerpiece and the top layer, the middle layer, and the bottom layer. Washers may be used to prevent the riveted end of the rivets from pulling through the apertures in the layers. It will be readily apparent to those skilled in the art that any type of fastening or binding mechanism including, but not limited to, staples, clamps, bolts, pins, clips, nuts, screws, nails, or tacks may be used to secure the headplate assembly together.

The progressive flex headplate assembly of the present invention resembles, in both form and function, a mechanical leaf spring. The flexible, resilient layers provide each of the legs of the headplate assembly with a progressive flex capability. Each leg can be flexed to accommodate horses having withers of differing widths. Nonetheless, in combination with the headplate centerpiece, the flexible legs/points of the headplate assembly also are provided with variable resistance in response to flexure of the legs. As constructed, the legs are permitted to progressively flex, with the flexing capability increasing (and resistance decreasing) down the length of each leg—with maximum flexure (and minimum resistance) occurring near the points of each leg. Thus, the headplate assembly is provided with a non-linear resistance function, similar to that of a mechanical leaf spring. Therefore, the headplate assembly is afforded the capability to accommodate different sizes of horses.

The headplate assembly, and thus the saddle tree and the saddle constructed therewith, can properly fit horses of varying widths. Indeed, this feature allows the points of the saddle tree to lie parallel to the withers regardless of the width of the horse. Because the headplate assembly is designed to progressively flex and yet contains a rigid headplate centerpiece, the saddle tree constructed therewith provide a better fitting saddle, with the saddle tree and the headplate assembly being able to adjust to account for movement of the horse's body—with the resistance of the headplate assembly maintaining the saddle in proper position without pinching or putting pressure on top of the withers or on the horse's spine.

Depending on the desired amount of progressive flex, the type of saddle, and the materials of construction, the number of narrow, flexible segments or layers included in the headplate assembly of the present invention may vary. Preferably, there are from two to five layers in the headplate assembly of the present invention. In addition, the length of each layer and the length of the headplate centerpiece may vary depending on the desired amount of rigidity or progressive flex, the type of saddle, and/or the size of the horse.

The connecting portion of the saddle tree of the present invention connects the cantle portion to the headplate assembly, without the use of rigid rails that are connected to both the pommel portion and cantle as traditionally done in the prior art. Rather, the connecting portion used to connect the headplate assembly and the cantle of the present invention is constructed of leather or another flexible, yet rugged materials(s).

Thus, the connecting portion connects the cantle to the pommel/headplate assembly without inhibiting the progressive flexibility of the legs and the points of the headplate assembly. Further, the connecting portion also provides the suspension system necessary to support the flocking and/or foam, the seat, and the other panels necessary to construct a saddle therefrom. In the completed progressive flex saddle tree of the present invention, the flexible connecting portion permits the cantle and the pommel portion/headplate assembly to move and flex independently from each other in response to movement of the horse during riding.

In alternate embodiments, the saddle tree and headplate assembly of the present invention may additionally include flexible connecting rails. The flexible connecting rails may be formed integrally with one of the flexible, resilient layers of the headplate assembly, and are positioned on either side of the pommel portion of the headplate assembly. Preferably, the connecting rails are formed within the top layer of the headplate assembly and extend from the headplate assembly to the cantle of the saddle tree.

Each of the connecting rails may be constructed of nylon, vinyl, polyethylene, polystyrene, polypropylene, polyvinyl chloride, or any similar flexible yet resilient material. Alternatively, the connecting rails may be constructed of steel, or another metal or composite material exhibiting the flexibility and resilience required for the headplate assembly. While the connector rails are constructed of a flexible resilient material, the connector rails provide some added stability to the saddle tree without obstructing or interfering with the progressive flex function of the headplate assembly.

Because the connecting rails are formed integrally with one of the layers in the headplate assembly, the connecting rails permit the saddle tree, and thus the saddle formed therewith, to properly fit a wide variety of different sized horses. The connector rails move proportionally with the legs of the headplate assembly, and as such, are always in the correct position along the horse's back—without pinching or pressing against the horse's spine.

Consistent with the broader aspects of the present invention, the flexible connector rails may instead be formed as separate pieces and secured at one end to one of the layers of the headplate assembly and secured at the other end to the cantle of the saddle tree.

It may therefore be seen that the saddle tree including the progressive flex headplate of the present invention overcomes the disadvantages of the prior art by providing a headplate assembly, as well as a saddle tree and a saddle constructed therewith, having progressive flex that permits the saddle to fit more than one size horse. Accordingly, it may been seen that the progressive flex headplate assembly of the present invention provides a better fitting saddle tree and saddle by allowing flexure of the legs/points in order to accommodate movement of the horse during riding, thereby eliminating soreness and injury to the horse.

The saddle tree including the progressive flex headplate assembly of the present invention is of a construction which is both durable and long lasting, and which will require little or no maintenance to be provided by the user throughout its operating lifetime. The saddle tree including the progressive flex headplate assembly of the present invention is also of inexpensive construction to enhance its market appeal and to thereby afford it the broadest possible market. Finally, all of the aforesaid advantages and objectives of the saddle tree including the progressive flex headplate assembly of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
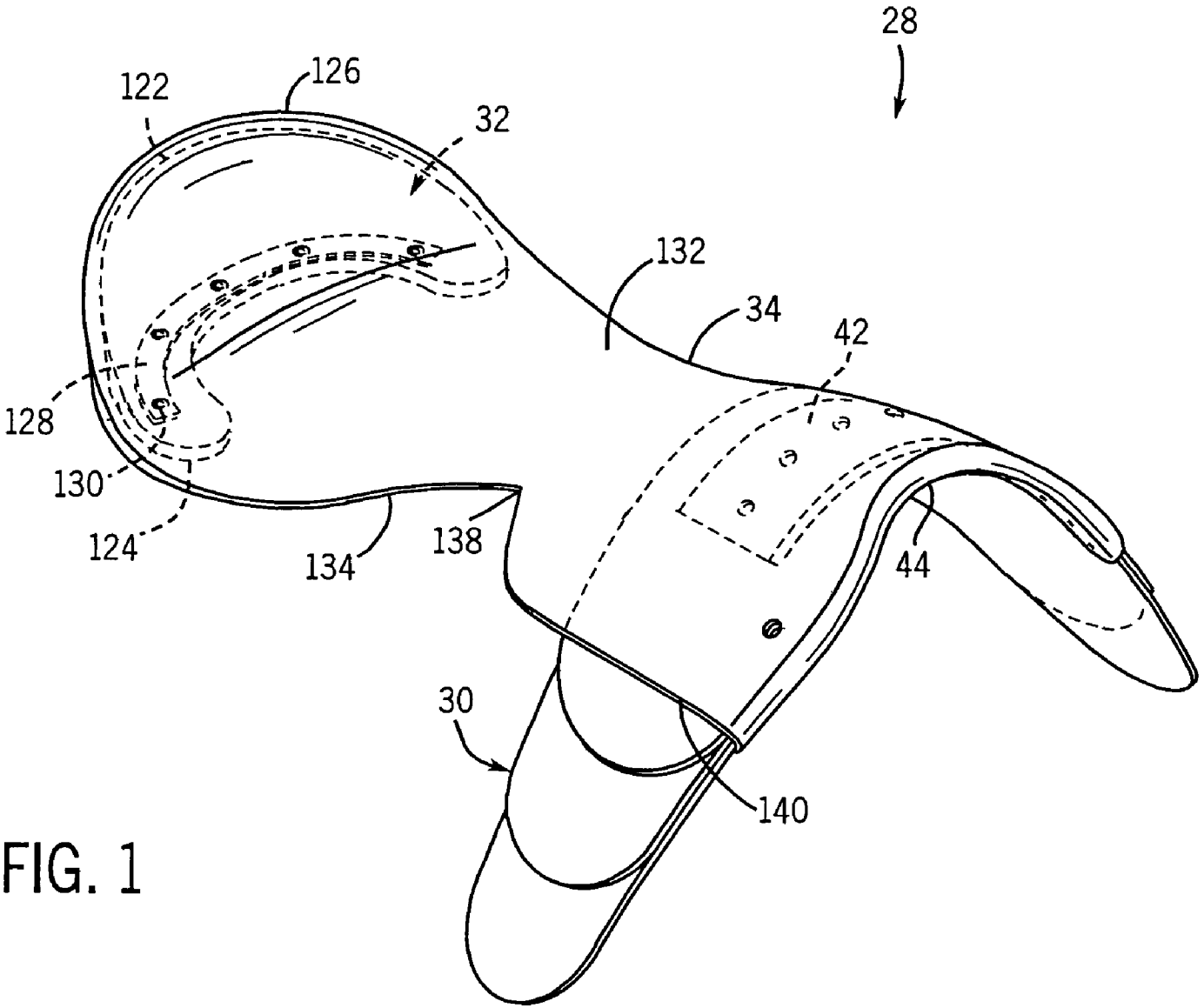
FIG. 1 is an isometric view of a progressive flex saddle tree including a progressive flex headplate which is constructed in accordance with the present invention.

Consistent with the teachings of the present invention, the heart of a progressive flex saddle tree 28 is a headplate assembly 30 of novel construction, as illustrated in FIG. 1. The saddle tree 28 of the present invention in its simplest form consists of the headplate assembly 30, a cantle portion 32, and a connecting portion 34.

Figure 2:
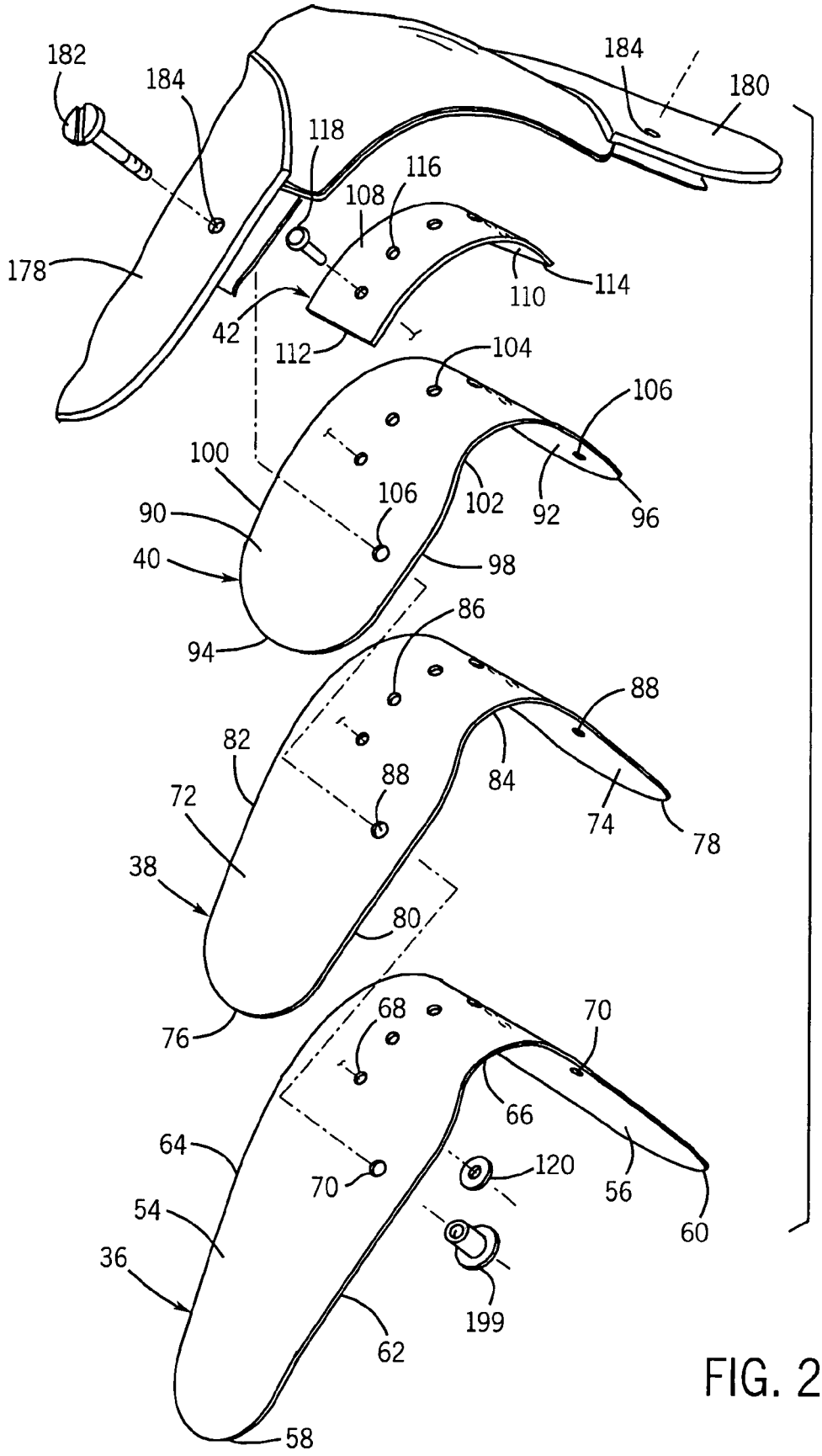
FIG. 2 is an exploded, isometric view of the preferred headplate assembly shown in FIG. 1 (with a portion of the saddle tree not shown)
Figure 3:
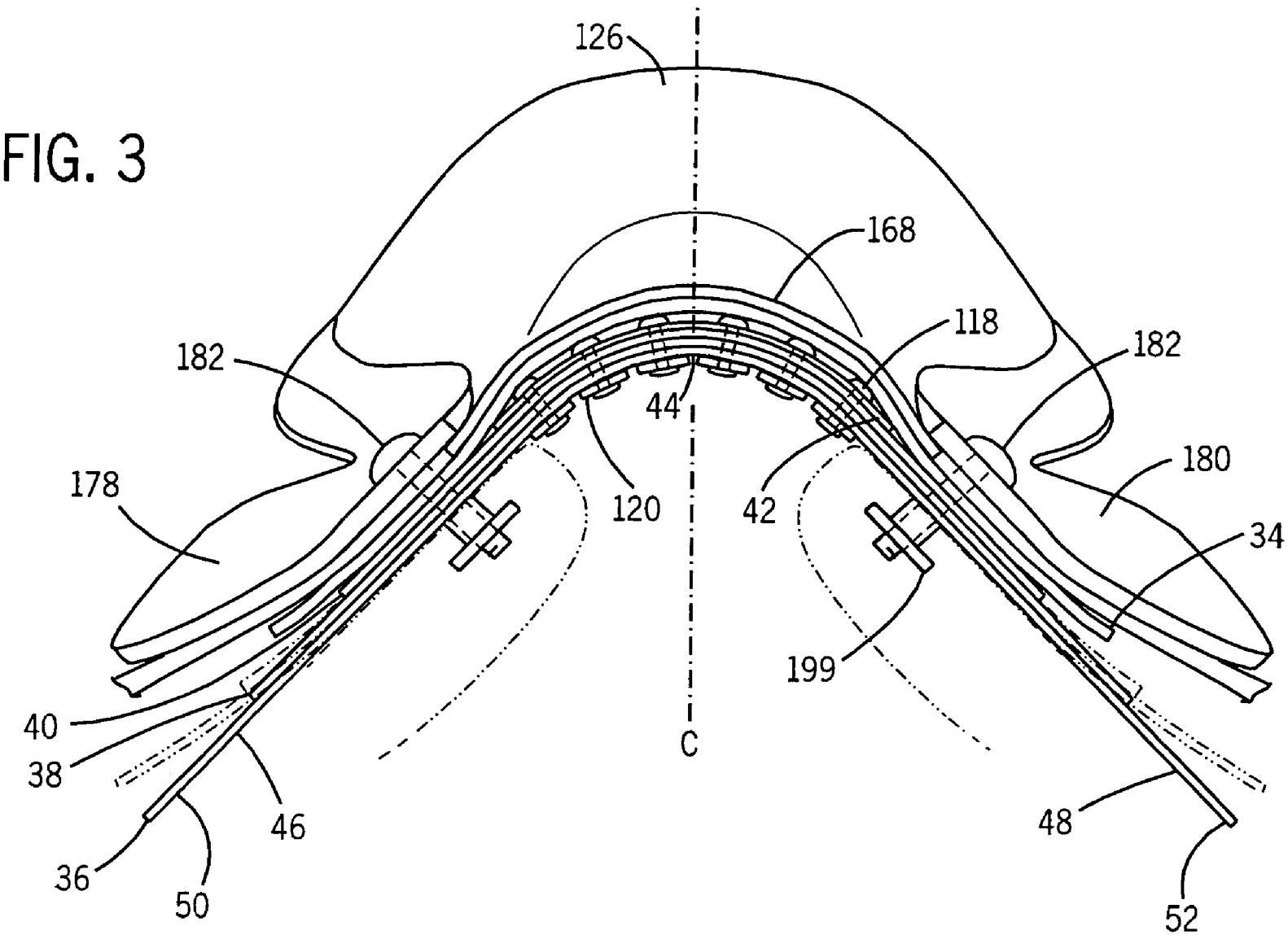
FIG. 3 is a front view of the saddle tree shown in FIGS. 1 and 2, with additional components of a saddle shown as being installed thereupon, illustrating the progressive flex of each leg of the headplate assembly.

As best illustrated in FIGS. 2 and 3, the headplate assembly 30 includes narrow, flexible layers 36, 38, and 40 and a headplate centerpiece 42. The headplate assembly 30 has a configuration generally similar to an inverted V with the apex of the V being rounded (as best shown in FIG. 3), with a rounded pommel portion 44 and a pair of symmetrical, opposing legs indicated generally at 46 and 48. The legs 46 and 48 extend at an angle downwardly on opposite sides of the pommel portion 44 to form points 50 and 52, at the respective distal ends of the headplate assembly 30. In a completed saddle, the pommel portion 44 will fit over the withers of the horse and the legs 46 and 48 will extend at an angle downwardly towards the ground, terminating in points 50 and 52, respectively.

Referring back to FIG. 2, the bottom layer 36 of the headplate assembly 30 has a top side 54, a bottom side 56, and opposing ends 58 and 60. The bottom layer 36 also has a front edge 62 and a back edge 64. A small, curved indentation 66 is formed within the front edge 62 of the bottom layer 36 which will be located at the pommel portion 44 of the completed headplate assembly 30. In addition, a plurality of apertures 68 are formed within the bottom layer 36 for securing the components of the headplate assembly 30 together. Two apertures 70 are also provided within the bottom layer 36 to secure the completed headplate assembly 30 within a constructed saddle when the saddle tree 28 is complete.

The middle layer 38 of the headplate assembly 30 has a top side 72, a bottom side 74, and opposing ends 76 and 78. The middle layer 38 also has a front edge 80 and a back edge 82. A small, curved indentation 84 is formed within the front edge 80 of the middle layer 38 which will be located at the pommel portion 44 of the completed head plate assembly 30. Further, a plurality of apertures 86 are formed within the middle layer 38 for securing the components of the headplate assembly 30 together. Two apertures 88 are also formed within middle layer 38 to secure the completed headplate assembly 30 to a saddle when the saddle tree 28 is complete.

Figure 4:
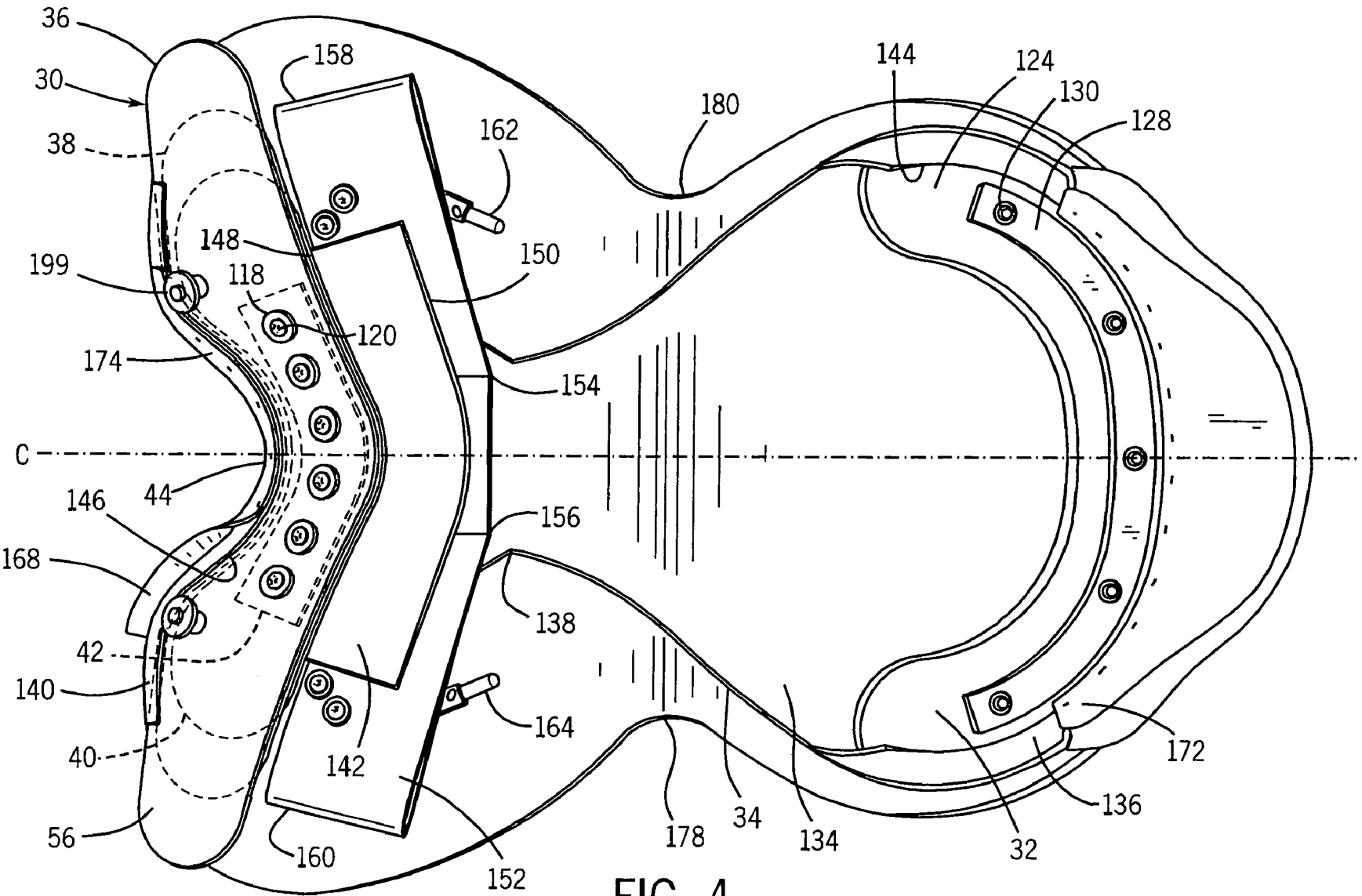
FIG. 4 is a bottom plan view of the saddle tree shown in FIGS. 1 through 3.

As illustrated in FIGS. 2 through 4, the middle layer 38 is shorter in length and wider at its ends 76 and 78 than the bottom layer 36. In the completed saddle tree 28, the middle layer 38 will overlay the bottom layer 36 such the bottom side 74 of the middle layer 38 is positioned adjacent to the top side 64 of bottom layer 36 with the indentation 84, the apertures 86 and the apertures 88 in the middle layer 38 being substantially aligned with the indentation 66, the apertures 68 and the apertures 70 in the bottom layer 36.

The top layer 40 of the headplate assembly 30 has a top side 90, a bottom side 92, and opposing ends 94 and 96. The top layer 40 also has a front edge 98 and a back edge 100. The top layer 40 has a small, curved indentation 102 formed within the front edge 98 of the top layer 40 which will be located at the pommel portion 44 of the completed head plate assembly 30. A plurality of apertures 104 are formed within the top layer 40 for securing the headplate assembly 30 together. Two apertures 106 are also provided within the top layer 40 to secure the completed headplate assembly 30 to a saddle when the saddle tree 28 is complete.

As illustrated in FIGS. 2 through 4, the top layer 40 is shorter in length and wider at its ends 94 and 96 than the middle layer 38. In the completed saddle tree 28, the top layer 40 will overlay the middle layer 38 such the bottom side 92 of the top layer 40 is positioned adjacent to the top side 72 of middle layer 38 with the indentation 102, the apertures 104 and the apertures 106 in the top layer 40 being substantially aligned with the indentation 84, the apertures 86 and the apertures 88 in the middle layer 34.

It will be appreciated by those skilled in the art that the layers 36, 38, and 40 may, rather than becoming narrower at their respective ends from the top layer 40 to the bottom layer 36, have a uniform width from top layer 40 to the bottom layer 36.

The layers 36, 38, and 40 of the present invention may be made of nylon, vinyl, polyethylene, polystyrene, polypropylene, polyvinyl chloride, or any similar flexible yet resilient material. Consistent with the broader aspects of the present invention, the layers 36, 38, and 40 may also be constructed of steel, or any other metal or composite material exhibiting the appropriate flexibility and resilience.

Referring back to FIG. 2 for the moment, the headplate centerpiece 42 has a top side 108, a bottom side 110, and opposing ends 112 and 114. A plurality of apertures 116 are formed within the headplate centerpiece 42 for securing the components of the headplate assembly 30 together. The headplate centerpiece 42 is constructed of a rigid material to provide a firm and relatively unyielding structure to the pommel portion 44 of the headplate assembly 30. Therefore, the headplate centerpiece 42 may be constructed with materials such as wood, metal (e.g. steel or iron), rigid thermoplastic or polymer material, and/or composites thereof that provide a rigid structure to the headplate centerpiece 42.

As illustrated in FIGS. 3 and 4, to construct the headplate assembly 30, the layers 36, 38 and 40 are arranged overlying each other, starting with the bottom layer 36 (which is the longest layer), with the middle layer 38 (the next longest layer) overlying the bottom layer 36, and then with the top layer 40 (the shortest layer), overlying the middle layer 38, as described above. Next, the headplate centerpiece 42 is positioned overlying the top layer 40 such that the bottom side 110 of the headplate centerpiece 42 is adjacent to the top side 90 of the top layer 40 with the apertures 116 of the headplate centerpiece 42 being aligned with the apertures 104 of the top layer 40, the apertures 86 of the middle layer 38, and apertures 68 of the bottom layer 36.

The headplate assembly 30 is secured together using a series of rivets 118 and washers 120, as illustrated in the FIGS. 2 through 4. Each of the rivets 118 passes consecutively through an aperture 116 in the headplate centerpiece 42, an aperture 104 in the top layer 40, an aperture 86 in the middle layer 38, and an aperture 68 in the bottom layer 36, and then passes through a washer 120, with the rivets 118 securing the headplate assembly 30 together, as illustrated in FIGS. 2 through 4. It will be readily apparent to those skilled in the art that any other suitable type of fastening or binding mechanism including, but not limited to, staples, clamps, bolts, pins, clips, nuts, screws, nails, or tacks may be used to secure the headplate assembly 30 together. However, consistent with the broader aspects of the invention, the headplate assembly 30 may also be secured together by any other binding process known to those skilled in the art.

As best illustrated in FIGS. 1 and 3, the headplate assembly 30 of the present invention resembles, in both form and function, a mechanical leaf spring, wherein the layers 36, 38, and 40 afford each of the legs 46 and 48 a progressive degree of flexibility. Each leg 46 and 48 of the headplate assembly 30 can be flexed (as shown in FIG. 3); however, the layers 36, 38, and 40 of the headplate assembly 30 provide each leg 46 and 48 with progressive flex (and variable resistance) in response to flexure of the legs 46 and 48. Because the layers 36, 38 and 40 are constructed of a resilient material, the legs 46 and 48 are permitted to progressively flex, with the flexing capability increasing (and the resistance decreasing) along the length of each of the legs 46 and 48 approaching the points 36 and 52, respectively—with maximum flexure (and minimum resistance) occurring near the points 50 and 52 of the headplate assembly 30. Thus, the headplate assembly 30, and more particularly the legs 46 and 48 of the headplate assembly, provide a load bearing and non-linear resistance function to the saddle tree 28, similar to that of a mechanical leaf spring.

The progressive flex provided to each of legs 46 and 48 permits the headplate assembly 30, and thus the saddle tree 28 and saddle constructed therefrom, to conform to the bodily shape of the horse and therefore to properly fit horses of varying widths and shapes. Indeed, this feature allows the points 50 and 52 of the saddle tree 28 to lie parallel to the withers regardless of the width of the horse. Because the headplate assembly 30 is designed to progressively flex and yet contains a rigid headplate centerpiece 42, the saddle tree 28 and saddle constructed therefrom provides a better fitting saddle, allowing the saddle tree 28 and the headplate assembly 30 to adjust to account for movement of the horse's body—with the resistance of the headplate assembly 30 maintaining the saddle in proper position without pinching, or putting pressure on top of the withers or on the horse's spine.

It will be appreciated by those skilled in the art that the number of layers included in the headplate assembly 30 may vary depending on the desired degree of progressive flex, the type of saddle, and the materials used in the construction of the headplate assembly. Preferably, there are from two to five layers in the headplate assembly 30 of the present invention. In addition, the length of each layer and the length of the headplate centerpiece 42 may vary depending on the desired amount of rigidity or progressive flex desired, the type of saddle, and/or the size of the horse.

It will be further appreciated by one skilled in the art that the headplate assembly 30 may be constructed as one integral piece of flexible, resilient material having the pommel portion 44, legs 46 and 48, and points 50 and 52, wherein the headplate assembly 30 is constructed to be thicker at the pommel portion 44 and gradually becoming thinner down the length of each leg 44 and 46, with the thinnest portion of the headplate assembly 30 being located near the points 50 and 52 of each of the legs 46 and 48—thereby providing the same effect as a multi-layered headplate assembly.

Figure 5:
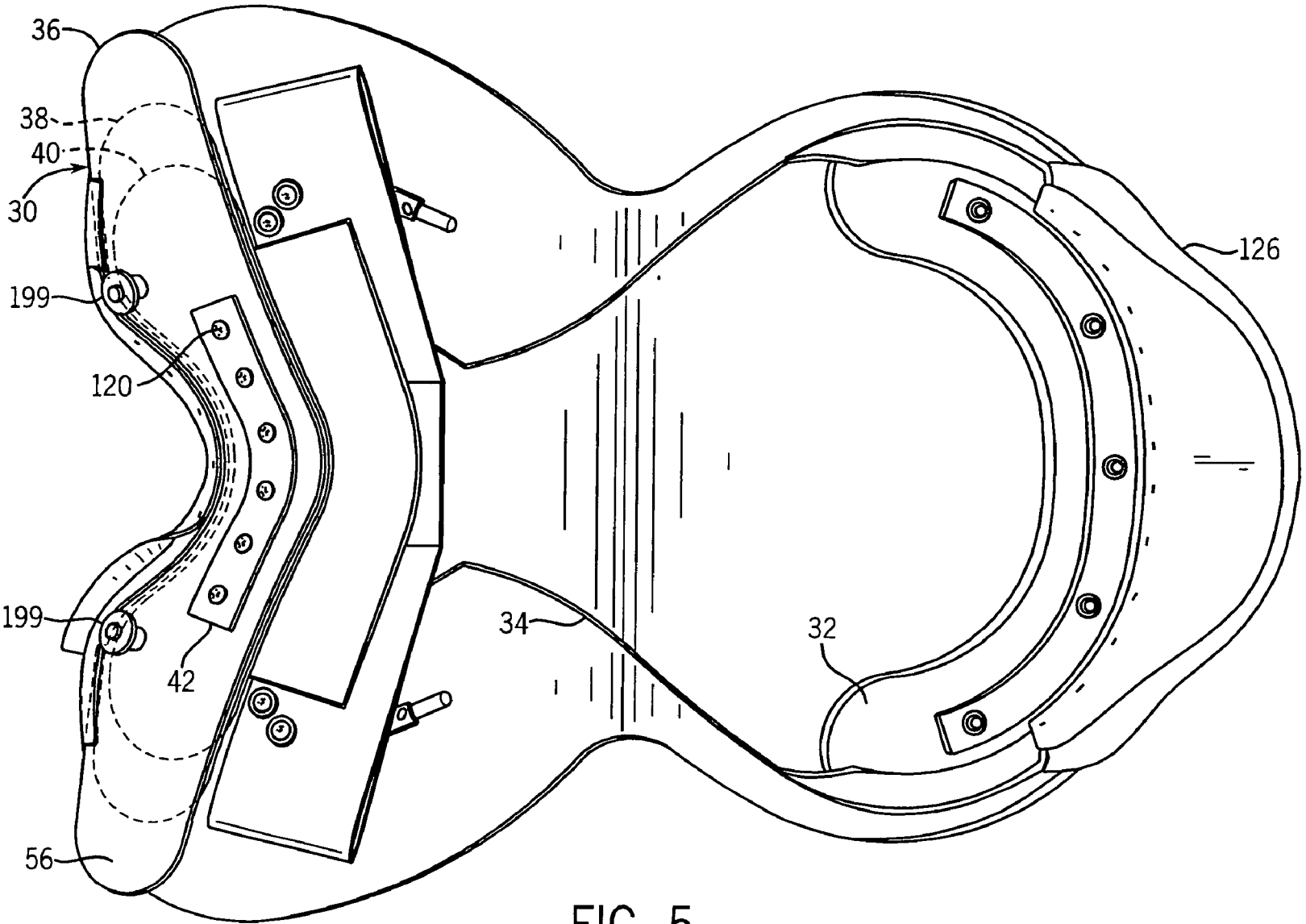
FIG. 5 is a bottom plan view of an alternate construction of the saddle tree shown in FIGS. 1 through 4, illustrating a headplate centerpiece secured to the bottom of the headplate assembly.

Referring again to FIGS. 1 and 4, in addition to the headplate assembly 30, the saddle tree 28 of the present invention also includes the cantle portion 32 and a connecting portion 34. The cantle portion 32 is situated opposite the headplate assembly 30, which will be located towards the back of the horse in the completed saddle. The cantle portion 32 is in the shape of an inverted U and provides form and definition to the seat back of the completed saddle. The cantle portion 32 has a top side 122 and a bottom side 124 (as best shown in FIG. 1). The top side 122 of the cantle portion 32 projects upwardly to form a seat back 126 of the completed saddle (as shown in FIG. 5). The bottom side 124 of the cantle portion 32 is substantially flat. The cantle portion 32 may be constructed of wood, fiberglass reinforced wood, plastic, foam, or any other material(s) known to those skilled in the art.

A support member 128, also in the shape of an inverted U, is mounted to the bottom side 124 of the cantle portion 32 to provide additional rigidity to the cantle portion 32. The support member 128 may be constructed of metal, plastic, or any other material known to those skilled in the art to provide a sufficient amount of rigidity to the cantle portion 32. Consistent with the broader aspects of the present invention, the cantle portion 32 may be constructed of a material, such as plastic, wood or metal, in which a support member is integrally formed within the cantle portion 32, or instead, the cantle portion 32 may be constructed, depending on the material of construction, without a support member 128.

A plurality of screws 130 are used to secure the support member 128 to the cantle portion 32. However, any other securing device or fastening mechanism such as bolts, rivets, staples, or nails may be used to secure the support member 128 to the cantle portion 32. In addition, any appropriate type of adhesive may instead be used to secure the support member 128 to the cantle portion 32.

As also illustrated in FIGS. 1 and 4, the connecting portion 34 of the saddle tree 28 of the present invention is shown. The connecting portion 34 connects the headplate assembly 30 to the cantle portion 32 of the saddle tree 28. The connecting portion 34 is substantially flat and is preferably constructed of leather. The connecting portion 34 may instead be constructed of nylon, woven or nonwoven fabrics, or any similar thin, flexible material or combination of materials.

The connecting portion 34 of the saddle tree 28 has a top side 132, a bottom side 134, a back end 136, a tapered portion 138 and a front end 140. The back end 136 of connecting portion 34 is substantially the same shape as but slightly larger than the cantle portion 32. Substantially in the middle of the connecting portion 34, the connecting portion 34 narrows to form the tapered portion 138. At the front end 140, the connecting portion 34 becomes wider and assumes substantially the shape of the pommel portion 44. The connecting portion 34 can optionally include a generally rectangular-shaped cover 142 for covering the headplate centerpiece 42 in the completed saddle tree 28.

To complete the saddle tree 28 of the present invention, the connecting portion 34 is placed top side 132 down so that it is lying flat and the cantle portion 32 is positioned top side 122 down on top of the connecting portion 34 and aligned with the back end 136 of the connecting portion 34. An edge 144 of the back end 136 of the connecting portion 34 is wrapped around the top side 122 of the cantle portion 32 and is folded over onto the bottom side 124 of the cantle portion 32, conforming to the inverted U shape of the cantle portion 32. The edge 144 is secured to the bottom side 124 of the cantle portion 32 using staples. Alternately, the edge 144 may be secured to the bottom side 124 of the cantle portion 32 using tacks, nails, an adhesive, or any other securing mechanism known to those skilled in the art.

Next, the headplate assembly 30 is aligned with the front end 140 of the connecting portion 34 such that the headplate centerpiece 42 and the pommel portion 44 are in contact with the bottom side 134 of the connecting portion 34 with the bottom side 56 of the layer 36, the bottom side 74 of the layer 38, and the bottom side 92 of the top layer 40 facing away from the bottom side 134 of the connecting portion 34. An edge 146 of the front end 140 of the connecting portion 34 is wrapped around the headplate assembly 30 and is folded over on to the bottom side 56 of the bottom layer 36. The edge 146 is secured to the bottom side 56 of the bottom layer 36 of the headplate assembly 30 using staples. However, the edge 146 may be secured to the bottom side 56 of the bottom layer 36 of the headplate assembly 30 using tacks, nails, an adhesive, or any other securing mechanism known to those skilled in the art.

As will be appreciated by those in the art, the connecting portion 34 not only connects the cantle portion 32 to the pommel portion 44 and the headplate assembly 30 of the present invention, it also provides the suspension system necessary to support the flocking and/or foam, the seat, and the other panels necessary to construct a saddle therefrom. The flexible connecting portion 34 of the present invention permits the cantle portion 32 and the pommel portion 44 and the headplate assembly 30 to move independently from each other.

Next, the cover 142 is added to the saddle tree 28. The cover 142 includes opposing edges 148 and 150. The edge 148 is joined to the bottom side 134 of the connecting portion 34 at a position adjacent to the headplate assembly 30. The edge 148 is preferably joined to the connecting portion 34 by stitching; however, it may be joined using staples, tacks or any other securing mechanism known to those skilled in the art.

The cover 142 is then folded over the headplate centerpiece 42 and the edge 150 is secured to the bottom side 56 of the bottom layer 36, covering the headplate centerpiece 42. The edge 150 is secured to the bottom side 56 of the bottom layer 36 of the headplate assembly 30 using staples; however, tacks, nails, adhesive or any other securing mechanism known to those skilled in the art may also be used to secure the edge 150 to the bottom side 56 of the bottom layer 36.

As will be readily apparent to those skilled in the art, because the connecting portion 34 of the saddle tree 28 of the present invention is constructed of a leather material and therefore flexible, the saddle tree 28 can flex about a center axis C (illustrated in FIGS. 3 and 4) wherein the saddle tree 28 can conform to movement of the horse's shoulders and back while being ridden and/or the shape of the horse.

In preparation for use in a riding saddle of the present invention, the saddle tree 28 includes a strap 152 positioned on the bottom side 134 of the connecting portion 34 adjacent the headplate assembly 30. The strap 152 is formed in a loop and joined at two locations 154 and 156 to the bottom side 134 of the connecting portion 34. In this way, the strap 152 forms two opposing loops 158 and 160 (on opposite sides of axis C, as shown in FIG. 4). Stirrup bars 162 and 164 are riveted to each of the loops 158 and 160, respectively.

Referring for the moment to FIG. 5, an alternate embodiment of the headplate assembly 30 is shown in which the headplate centerpiece 42 is mounted underneath the bottom layer 36. In this configuration, the top side 108 of the headplate centerpiece 42 is mounted adjacent to the bottom side 56 of the bottom layer 36 with the apertures 116 of the headplate centerpiece 42 being aligned with the apertures 68 of the bottom layer 36 before the headplate assembly 30 is secured together.

Figure 6:
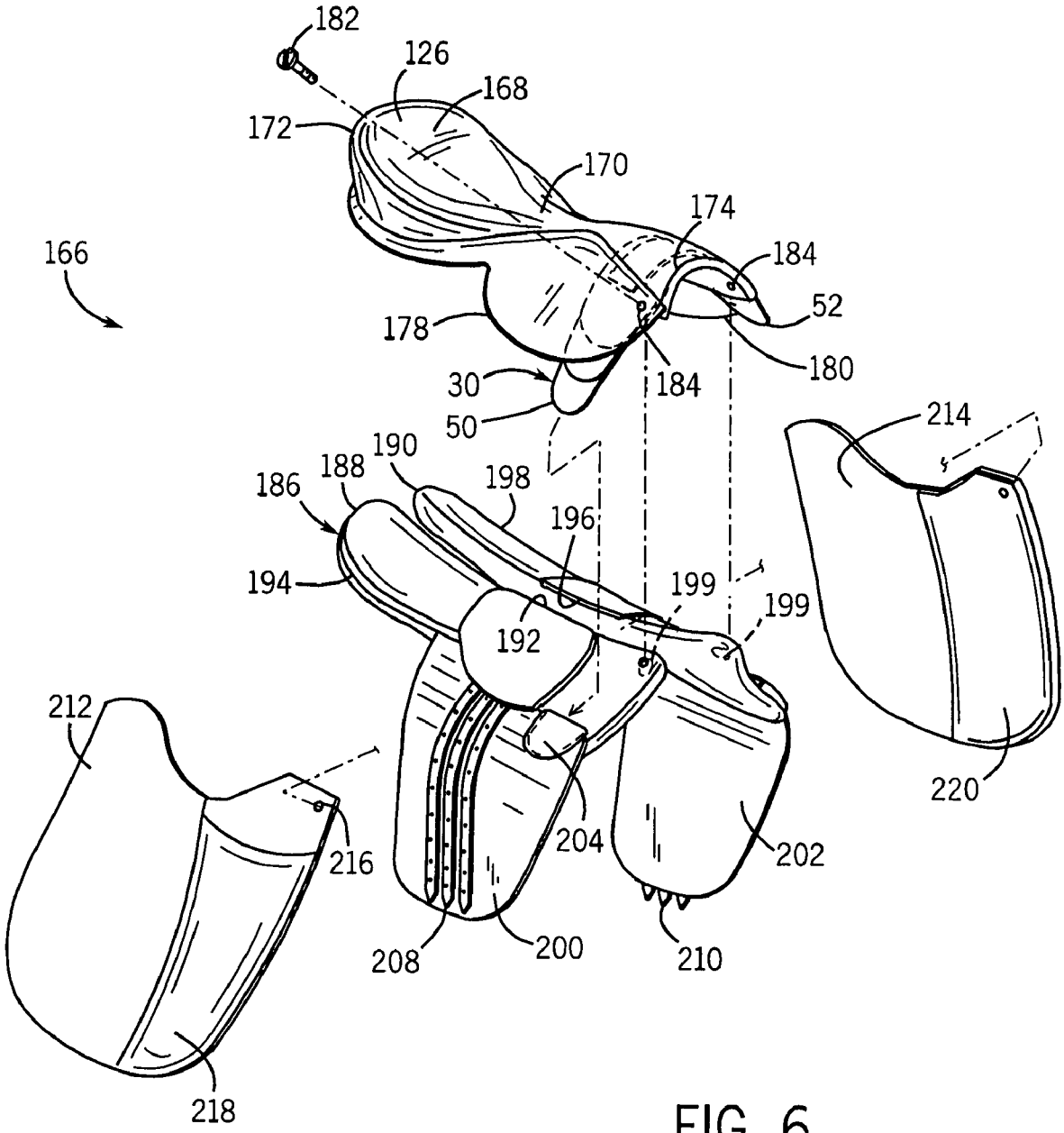
FIG. 6 is an exploded view of a saddle constructed in accordance with the present invention, including the saddle tree and headplate assembly shown in FIGS. 1 through 4.

An exploded view of a completed saddle 166 of the present invention is illustrated in FIG. 6. As shown in FIG. 6, in addition to FIGS. 1-5, the saddle 166 is built up using the saddle tree 28 having a progressive flex headplate assembly 30 of the present invention. First, the saddle tree 28 is flocked or covered with material to provide comfort and cushion for the rider. The saddle tree 28 may be flocked with wool, foam (urethane polymer), felt, wood or natural fiber stock, acrylic fiber, rubber, air, or any other material known to those skilled in the art, depending on the saddle's end-use application.

The cantle portion 32 and the pommel portion 44 are then tightly covered with a seat panel 168, to form a seat 170. As illustrated in FIG. 4, the seat panel 168 is substantially the same configuration of the connecting portion 34, having a first end 172 conforming to the inverted-U shape of the cantle portion 32 and a second end 174 conforming to the shape of the pommel portion 44. The seat panel 168 is tightly wrapped around the top side 122 of the cantle portion 32 and tacked or stapled on its first end 172 to the bottom side 124 of the cantle portion 32. The seat panel 168 is also tightly wrapped around the pommel portion 44 of the saddle tree 28 and tacked or stapled on its second end 174 to the headplate assembly 30, in manner similar to the installation of the connecting portion 34.

After installation of the seat panel 168, skirt panels 178 and 180 are then added to the saddle tree 28 by stitching, or otherwise securing the side panels 178 and 180 to the seat panel 168 or to the saddle tree 28 itself. The skirt panels 178 and 180 are included in the saddle 166 to cover the stirrup bars 162 and 164. The seat panel 168 and skirt panels 178 and 180 are preferably constructed of leather; however, any material known to those skilled in the art for use in riding saddles may be used in accordance with the present invention. In addition, the seat panel 168 and the skirt panels 178 and 180 may be constructed of a single integral unit and attached to the saddle tree 28 in any manner known to those skilled in the art.

As illustrated in FIG. 6, in addition to FIGS. 2 and 3, bolts 182 are used to secure the skirt panels 178 and 180 to the saddle tree 28, and thus, the headplate assembly 30. Each bolt 182 passes through apertures 184 in each of the skirt panels 178 and 180 and through the corresponding apertures 106, 88 and 70 in the layers 40, 38 and 36 of the headplate assembly 30, respectively. Bolts 182 will also be used to secure the saddle tree 28 to additional components of the saddle 166 together.

As also illustrated in FIG. 6, a lower portion 186 of the saddle 166 is provided. Included in the lower portion 186 of the saddle 166 are two opposing, elongated members 188 and 190 which run from the cantle portion 32 to the pommel portion 44 along the entire length of the saddle tree 28. The elongated members 188 and 190 are positioned to lie along both sides the horse's spine when the saddle 166 is properly secured on to the horse. The elongated members 188 and 190 are preferably made of leather.

Consistent with the present invention, the elongated members 188 and 190 are preferably constructed in the form of leather pockets wherein each of the elongated members 188 and 190 are stuffed with flocking, foam or another stuffing material to produce a cushioned, padded area that will help insulate the horse's back from the saddle tree 28 and the weight of the rider, as illustrated in FIG. 6.

The elongated member 188 has opposing side edges 192 and 194. Likewise, the elongated member 190 also has opposing sides 196 and 198. The elongated members 188 and 190 may be joined directly together at their side edges 192 and 196, respectively, or the elongated members 188 and 190 may be joined with a narrow leather strip (not shown in FIG. 6). In addition, nuts 199 for receiving the bolts 182 are included in each of the elongated members 188 and 190.

Leather underflaps 200 and 202 are provided and lie over opposite sides of the horse when the saddle is in use. The leather underflaps 200 and 202 are designed to protect the sides of the horse's body from the stirrup bars 162 and 164, from the girth strap and from friction of the rider's movement. The leather underflap 200 is secured to the elongated member 188 at the side 194 thereof. Likewise, the leather underflap 202 is secured to the elongated member 190 at the side 198 thereof. The underflaps 200 and 202 are preferably secured to the elongated members 188 and 190 by stitching; however, any conventionally used method for joining the leather underflaps 200 and 202 to the elongated members 188 and 190 may be used.

Each of the leather underflaps 200 and 202 is provided with a pocket 204 and 206 (the pocket 206 is in a location on leather underflap 202 similar to the location of the pocket 204 on underflap 200, although not shown on FIG. 6). In the completed saddle 166, the pocket 204 receives point 50 extending from the leg 46 of the headplate assembly 30. Likewise, the pocket 206 receives point 52 extending from the leg 48 of the headplate assembly 30. Thus, the pockets 204 and 206 also help secure the saddle tree 28 to the lower portion 186 of the saddle 166.

Girth tabs 208 and 210 are also provided on each side of the saddle 166 and are secured on top of each underflap 200 and 202 on opposing sides of the saddle 166. The girth tab 208 is secured to the saddle 166 at the seam of the underflap 200 and the elongated member 188 at the side 194 thereof. Likewise, the girth tab 210 is secured to the saddle 166 at the seam of the underflap 202 and the elongated member 190 at the side 198 thereof. The girth tabs 208 and 210 are provided on opposite sides of the horse in order to attach the girth strap when the saddle is installed on to the horse.

To complete the saddle 166 of the present invention, leather saddle flaps 212 and 214 are provided. Each of the saddle flaps 212 and 214 include an aperture 216 to help secure the lower portion 186 of saddle 166 together with the saddle tree 28. The saddle flap 212 is secured to the elongated member 188 at the side 192 thereof. Likewise, the saddle flap 214 is secured to the elongated member 190 at the side 196 thereof. The saddle flaps 212 and 214 are preferably secured to the elongated members 188 and 190 by stitching; however, any conventionally used method for joining the saddle flaps 212 and 214 to the elongated members 188 and 190 may be used.

Knee pads 218 and 220 may be provided on each of the saddle flaps 212 and 214, as shown in FIG. 6. Each knee pad 218 and 220 is positioned on the saddle flaps 212 and 214 towards the front of the saddle 166, and provide added cushion and padding to the saddle flaps 212 and 214 in order to protect the horse from pressure from the legs of the rider. Each knee pad 218 and 220 will be filled with latex foam or any other type of flocking material known in the art, similar to that used to cover the saddle tree 28 and/or in the elongated members 188 and 190.

Finally, as illustrated in FIG. 6, the finished saddle tree 28 (including the headplate assembly 30 and the skirt panels 178 and 180) and the lower portion 86 of the saddle 166 are joined together by the bolts 182. Each bolt 182 pass through each of the apertures 184 in each of the skirt panels 178 and 180 and through the corresponding apertures 106, 88 and 70 in the layers 40, 38 and 36 of the headplate assembly 30, respectively. Each bolt will also pass through each aperture 216 in the saddle flaps 212 and 214 and will be received by each of the nuts 199 in the elongated members 188 and 190. It will be readily apparent to those skilled in the art, that the completed saddle tree 28 and the lower portion 186 of the saddle 166 may be joined together in any manner known to those skilled in the art.

Figure 7:
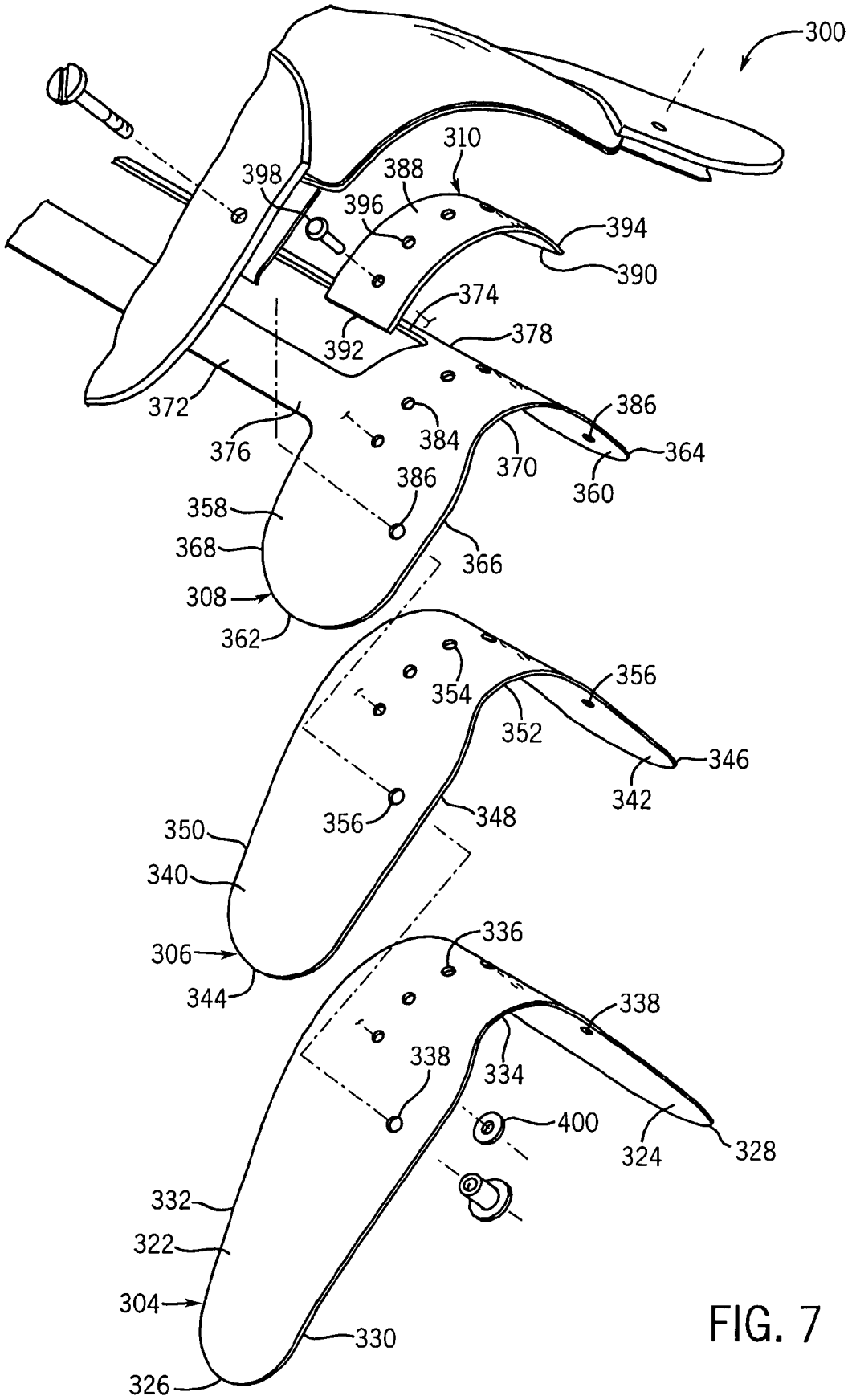
FIG. 7 is a partial, exploded view of an alternate embodiment headplate assembly constructed in accordance with the present invention, showing flexible connecting rails extending rearwardly therefrom.
Figure 8:
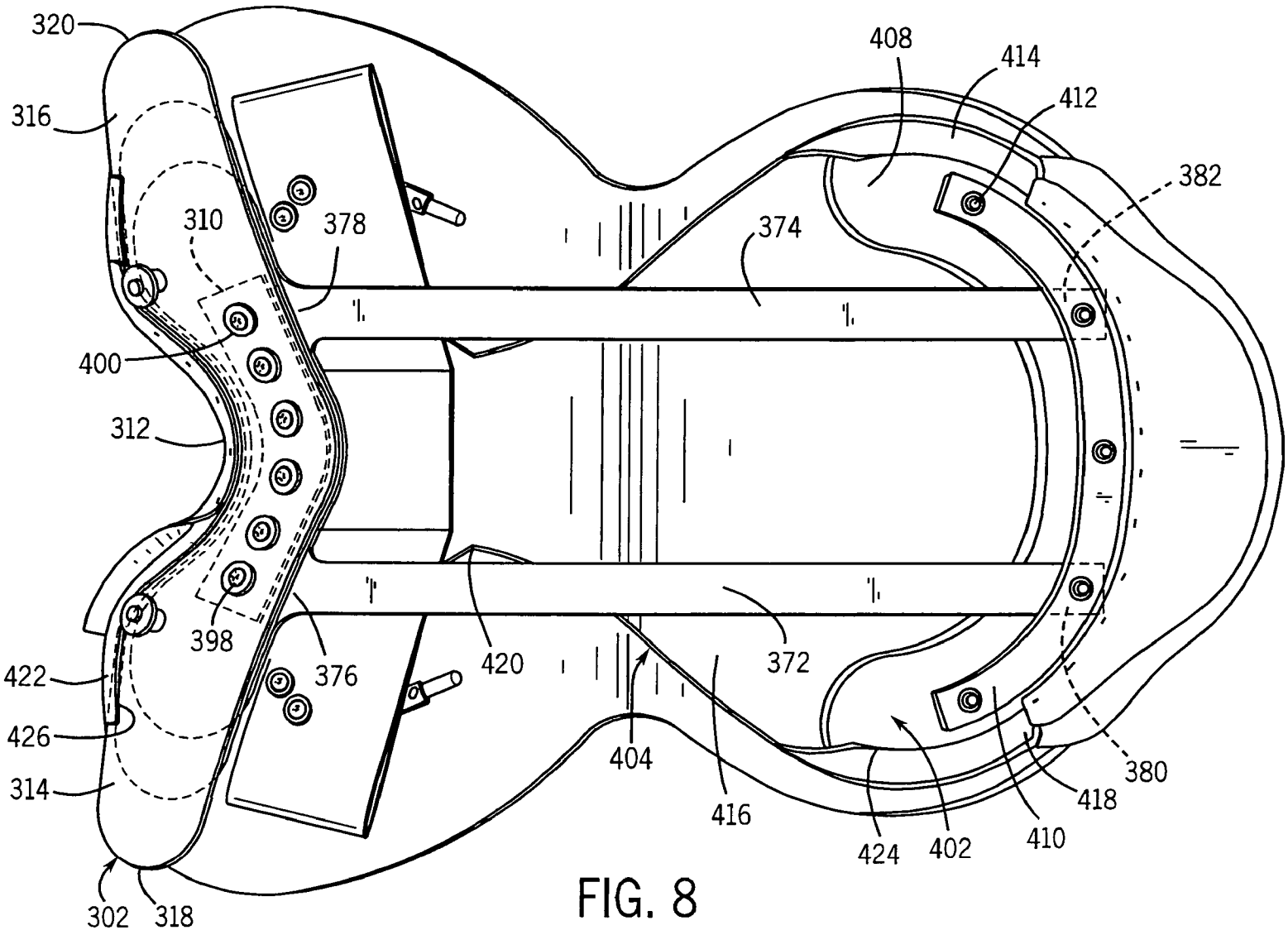
FIG. 8 is a bottom plan view of a saddle tree constructed using the alternate embodiment headplate assembly shown in FIG. 7.

Referring next to FIGS. 7 and 8, an alternate embodiment of a progressive flex saddle tree 300 and headplate assembly 302 of novel construction are shown. The headplate assembly 302 includes narrow, flexible layers 304, 306 and 308 and a rigid headplate centerpiece 310. The headplate assembly 302 has generally an inverted V-shape, with a rounded pommel portion 312 and a pair of symmetrical, opposing legs 314 and 316. The legs 314 and 316 extend downwardly on opposite sides of the pommel portion 312 to form points 318 and 320, respectively. In a completed saddle, the pommel portion 312 will fit over the withers of the horse and the legs 314 and 316 will extend downward towards the ground, terminating in points 318 and 320, respectively,.

The bottom layer 304 of the headplate assembly 302 has a top side 322, a bottom side 324, and opposing ends 326 and 328. The bottom layer 304 also has a front edge 330 and a back edge 336. A small, curved indentation 334 is formed within the front edge 330 of the bottom layer 304 which will be located at the pommel portion 312 of the completed headplate assembly 302. In addition, a plurality of apertures 336 are formed within the bottom layer 304 for securing the components of the headplate assembly 302 together. Two apertures 338 are also provided within the bottom layer 304 to secure the completed headplate assembly 302 within a constructed saddle when the saddle tree 300 is complete.

The middle layer 306 of the headplate assembly 302 has a top side 340, a bottom side 342, and opposing ends 344 and 346. The middle layer 306 also has a front edge 348 and a back edge 350. A small, curved indentation 352 is formed within the front edge 348 of the middle layer 306 which will be located at the pommel portion 312 of the completed head plate assembly 302. Further, a plurality of apertures 354 are formed within the middle layer 306 for securing the components of the headplate assembly 302 together. Two apertures 356 are also formed within the middle layer 306 to secure the completed headplate assembly 302 to a saddle when the saddle tree 300 is complete.

As indicated in FIGS. 7 and 8, the middle layer 306 is shorter in length and wider at its ends 344 and 346 than the bottom layer 304. In the completed saddle tree 300, the middle layer 306 will overlay the bottom layer 304 such the bottom side 342 of the middle layer 304 is positioned adjacent to the top side 362 of bottom layer 304 with the indentation 352, the apertures 354 and the apertures 256 in the middle layer 306 substantially aligned with the indentation 334, the apertures 336 and the apertures 338 in the bottom layer 304.

The top layer 308 of the headplate assembly 302 has a top side 358, a bottom side 360, and opposing ends 362 and 364.

The top layer 302 also has a front edge 366 and a back edge 368. The top layer 308 has a small, curved indentation 370 formed within the front edge 366 of the top layer 308 which will be located at the pommel portion 312 of the completed head plate assembly 302.

As also illustrated in FIGS. 7 and 8, connector rails 372 and 374 are provided and extend outwardly from the back edge 368 of the top layer 308. Each of the connector rails 372 and 374 of the headplate assembly 302 have first ends 376 and 378 and second ends 380 and 382, respectively. Preferably, the connector rails 372 and 374 are integrally formed within the back edge 368 of the top layer 308 such that the connector rails 372 and 374 and the top layer 308 are one continuous piece of flexible material. Consistent with the broader aspects of the present invention, each of the connector rails 372 and 374 may be separate pieces of flexible material with each of the first ends 376 and 378 of the connector rails 372 and 374 secured independently to the top layer 308 of the headplate assembly 302.

Each of the connector rails 372 and 374 extends from the back edge 368 of the top layer 308 such that the first ends 376 and 378 extend rearwardly back from the top layer 308 on both sides of the pommel portion 312. The connector rails 372 and 374 run substantially parallel to each other along the length of the saddle tree 300 and each of the second ends 380 and 382 of connector rails 372 and 374 connect to the cantle portion of the completed saddle tree 300 (as shown in FIG. 8). It will at once be appreciated by one skilled in the art that the connector rails 372 and 374 may instead extend from, be formed within, or be directly connected to any of the layers 304, 306 and 308 of the headplate assembly 302.

A plurality of apertures 384 are formed within the top layer 308 for securing the components of the headplate assembly 302 together. Two apertures 386 are also provided within the top layer 308 to secure the completed headplate assembly 302 to a saddle when the saddle tree 300 is complete.

As illustrated in FIGS. 7 and 8, the top layer 308 is shorter in length and wider at its ends 362 and 364 than the middle layer 306. In the completed saddle tree 300, the top layer 308 will overlay the middle layer 306 such the bottom side 360 of the top layer 308 is positioned adjacent to the top side 340 of middle layer 306 with the indentation 370, the apertures 384 and the apertures 384 in the top layer 308 substantially aligned with the indentation 352, the apertures 354 and the apertures 356 in the middle layer 306.

It will be appreciated by those skilled in the art that the layers 304, 306 and 308 may, rather than becoming narrower at their respective ends from the top layer 308 to the bottom layer 304, have a uniform width from the top layer 308 to the bottom layer 304.

The layers 304, 308 and 308, including the connector rails 372 and 374, of the present invention may be nylon, vinyl, polyethylene, polystyrene, polypropylene, polyvinyl chloride, or any similar flexible yet resilient material. Consistent with the broader aspects of the present invention, the layers 304, 308 and 308 and/or the connector rails 372 and 374 may be constructed of steel, or any other metal or composite material exhibiting flexibility and resilience.

As can be seen from FIGS. 7 and 8, the headplate centerpiece 310 has a top side 388, a bottom side 390, and opposing ends 392 and 394. A plurality of apertures 396 are formed within the headplate centerpiece 310 for securing the components of the headplate assembly 302 together. The headplate centerpiece 310 is constructed of a rigid material to provide a firm and relatively unyielding structure to the pommel portion 312 of the headplate assembly 302. Therefore, the headplate centerpiece 310 may be constructed with materials such as wood, metal (e.g. steel or iron), rigid thermoplastic or polymer material, and/or composites thereof that provide a rigid structure to the headplate centerpiece 310.

To construct the headplate assembly 302, the layers 304, 308 and 308 are arranged overlaying each other, starting with the bottom layer 304 (which is the longest layer), with the middle layer 306 (the next longest layer) overlying the bottom layer 304, and then with the top layer 308 (the shortest layer) overlying the middle layer 306, as described above. Next, the headplate centerpiece 310 is positioned overlaying the top layer 308 such that the bottom side 390 of the headplate centerpiece 310 is adjacent to the top side 358 of the top layer 308 with the apertures 396 of the headplate centerpiece 310 being aligned with the apertures 384 of the top layer 308, the apertures 354 of the middle layer 306, and the apertures 336 of the bottom layer 304.

Consistent with the broader aspects of the present invention, the headplate centerpiece 310 may alternately be mounted underneath the bottom layer 308. In this configuration, the top side 388 of the headplate centerpiece 310 is adjacent to the bottom side 364 of the bottom layer 304 with the apertures 396 of the headplate centerpiece 310 being aligned with the apertures 336 of the bottom layer 304.

In either configuration, the headplate assembly 310 is secured together using a series of rivets 398 and washers 400, as illustrated in the FIGS. 7 and 8. Each of the rivets 398 passes consecutively through an aperture 396 in the headplate centerpiece 310, an aperture 384 in the top layer 308, an aperture 354 in the middle layer 306, and an aperture 336 in the bottom layer 304, respectively, and then passes through a washer 400, with the rivets securing the headplate assembly 302 together, as illustrated in FIGS. 7 and 8. It will be readily apparent to those skilled in the art that any other suitable type of fastening or binding mechanism including, but not limited to, staples, clamps, bolts, pins, clips, nuts, screws, nails, or tacks may be used to secure the headplate assembly 30 together. However, consistent with the broader aspects of the invention, the headplate assembly 30 may be secured together by any other binding process known to those skilled in the art.

As illustrated in FIGS. 7 and 8, the headplate assembly 302 of the present invention resembles, in both form and function, a mechanical leaf spring wherein the layers 304, 306, and 308 afford each of the legs 314 and 316 with a progressive degree of flexibility. Each leg 314 and 316 of the headplate assembly 302 can be flexed (in an identical fashion as illustrated in FIG. 3); however, the layers 304, 306, and 308 of the headplate assembly 302 provide each leg 314 and 316 with progressive flex (and variable resistance) in response to flexure of the legs 314 and 316. Because the layers 304, 306, and 308 are constructed of a resilient material, the legs 314 and 316 are permitted to progressively flex, with the flexing capability increasing (and the resistance decreasing) along the length of each of the legs 314 and 316 approaching the points 318 and 320, respectively—with maximum flexure (and minimum resistance) occurring near the points 318 and 320 of the headplate assembly 302. Thus, the headplate assembly 302, and more particularly, the legs 314 and 316 of the headplate assembly 302, provide a load bearing and non-linear resistance function to the saddle tree 300, similar to that of a mechanical leaf spring.

The progressive flex provided to each 314 and 316 permit the headplate assembly 302, and thus the saddle tree 300 and saddle constructed therewith, to conform to the bodily shape of the horse and therefore to properly fit horses of varying widths and shapes. Indeed, such feature allows the points 318 and 320 of the saddle tree 300 to lie parallel to the withers regardless of the width of the horse. Because the headplate assembly 302 is designed to progressively flex and yet contains a rigid headplate centerpiece 310, the saddle tree 300 and saddle constructed therefrom provides a better fitting saddle, allowing the saddle tree 300 and the headplate assembly 302 to adjust to account for movement of the horse's body—with the resistance of the headplate assembly 302 maintaining the saddle in proper position without pinching, or putting pressure on top of the withers or on the horse's spine.

Further, because the headplate assembly 302 is designed to flex to fit horses of different widths and because the connector rails 372 and 374 are integrally formed within the top layer 308 of the headplate assembly, the connector rails 372 and 374 also flex as the headplate assembly 302 is progressively flexed to fit different size horses. As the progressive flex headplate assembly 302 adjusts to fit a particular size of a horse, the connector rails 372 and 374 will flex proportionally to the flex of the top layer 308 of the headplate assembly 302, and therefore the connector rails 372 and 374 will be properly aligned on the horse's back on either side of the horse's spine.

It will be appreciated by those skilled in the art that the number of layers included in the headplate assembly 302 may vary depending on the desired degree of progressive flex, the type of saddle, and the materials used in the construction of the headplate assembly. Preferably, there are from two to five layers in the headplate assembly 302 of the present invention. In addition, the length of each layer and the length of the headplate centerpiece 310 may vary depending on the desired amount of rigidity or progressive flex desired, the type of saddle, and/or the size of the horse.

Referring again to FIGS. 7 and 8, in addition to the headplate assembly 302, the saddle tree 300 of the present invention also includes a cantle portion 402 and a connecting portion 404. The cantle portion 402 is situated opposite the headplate assembly 302, which will be located towards the back of the horse in the completed saddle. The cantle portion 402 is in the shape of an inverted U and provides form and definition to the seat back of the completed saddle. The cantle portion 402 has a top side (not shown in FIG. 8) and a bottom side 408. The top side of the cantle portion 402 projects upwardly to form a seat back of the completed saddle. The bottom side 408 of the cantle portion 402 is substantially flat. The cantle portion 402 may be constructed of wood, fiberglass reinforced wood, plastic, foam, or any material(s) known to those skilled in the art.

A support member 410, also in the shape of an inverted U, is mounted to the bottom side 408 of the cantle portion 402 to provide additional rigidity to the cantle portion 402. Importantly, the second ends 380 and 382 of the flexible connector rails 372 and 374 will be mounted to the cantle portion 402. The connector rails provide some additional rigidity to the saddle tree 300, while also remaining resilient and flexible to not only conform to the shape of the horse's back but also to permit progressive flexibility and resistance to the saddle tree 300 in response to movement of the horse. The connector rails 372 and 374 may be mounted to either side of the support member 410.

The support member 410 may be constructed of metal, plastic, or any material known to those skilled in the art to provide a sufficient amount of rigidity to the cantle portion 402. Consistent with the broader aspects of the present invention, the cantle portion 402 may be constructed of a material, such as plastic, wood or metal, in which a support member is integrally formed within the cantle portion 402, or instead, the cantle portion 402 may be constructed, depending on the material of construction, without a support member 410.

A plurality of screws 412 secure the support member 410 to the cantle portion 402. However, any other securing device or fastening mechanism such as bolts, rivets, staples, or nails may be used to secure the support member 410 to the cantle portion 402.

The connecting portion 404 of the saddle tree 300 is shown in FIG. 8 and configured in a similar manner to the embodiment described above. Accordingly, the connecting portion 404 connects the headplate assembly 302 to the cantle portion 402 of the saddle tree 300. The connecting portion 404 is substantially flat and preferably constructed of leather. The connecting portion 404 may instead be constructed of nylon, woven or nonwoven fabrics or any similar thin, flexible material or combination of materials.

The connecting portion 404 of the saddle tree 300 has a top side 414, a bottom side 416, a back end 418, a tapered portion 420 and a front end 422. The back end 418 of connecting portion 404 is substantially the same shape as but slightly larger than the cantle portion 402. At the tapered portion 420, the connecting portion 404 narrows, as illustrated in FIG. 8. At the front end 422, the connecting portion 404 becomes larger in width and assumes substantially the shape as the pommel portion 312.

To complete the saddle tree 300 of the present invention, the connecting portion 404 is placed top side 414 down so that it is lying flat and the cantle portion 402 is positioned top side down on top of the connecting portion 404 and aligned with the back end 418 of the connecting portion 404. An edge 424 of the back end 418 of the connecting portion 404 is wrapped around the top side of the cantle portion 402 and folded over on to the bottom side 408 of the cantle portion 402, conforming to the inverted U shape of the cantle portion 402. The edge 424 is secured to the bottom side 408 of the cantle portion 402 using staples. Alternatively, the edge 424 may be secured to the bottom side 408 of the cantle portion 402 using tacks, nails, adhesive or any other securing mechanism known to those skilled in the art.

Next, the headplate assembly 302 is aligned with the front end 422 of the connecting portion 404 such that the headplate centerpiece 310 and the pommel portion 312 are in contact with the bottom side 416 of the connecting portion 404 and with the bottom sides 390, 360, 342, and 364 of the layers 308, 306, and 304 are facing away from the bottom side 416 of the connecting portion 404. An edge 426 of the front end 422 of the connecting portion 404 is wrapped around the headplate assembly 302 and folded over on to the bottom side 364 of the bottom layer 304. The edge 426 is secured to the bottom side 364 of the bottom layer 304 of the headplate assembly 302 using staples. However, the edge 426 may instead be secured to the bottom side 364 of the bottom layer 304 of the headplate assembly 302 using tacks, nails, adhesive or any other securing mechanism known to those skilled in the art.

As will be appreciated by those in the art, the connecting portion 404 not only connects the cantle portion 402 to the pommel 312 and the headplate assembly 302 of the present invention, it also provides the suspension system necessary to support the flocking and/or foam, the seat and the other panels necessary to construct a saddle therefrom. The connecting portion 404 and connector rails 372 and 374 of the present invention permit the cantle portion 402 and the pommel portion 312 and the headplate assembly 302 to flex independently from each other in response to movement of the horse. The resilience of the material of the connector rails 372 and 374 also helps retain the saddle tree 300 in proper shape and configuration in order to ensure the saddle constructed therewith properly fits the horse.

Saddle tree 300, as illustrated in FIGS. 7 and 8, may be built up (as described in more detail herein with respect to the primary embodiment of the present invention) to form a saddle including the progressive flex saddle tree 300 and headplate assembly 302 of the present invention. The flexible connector rails 372 and 374 provide resilient, yet added structural strength to the saddle tree 300 which may be required in certain saddle applications, as well known to those skilled in the art.

Figure 9:
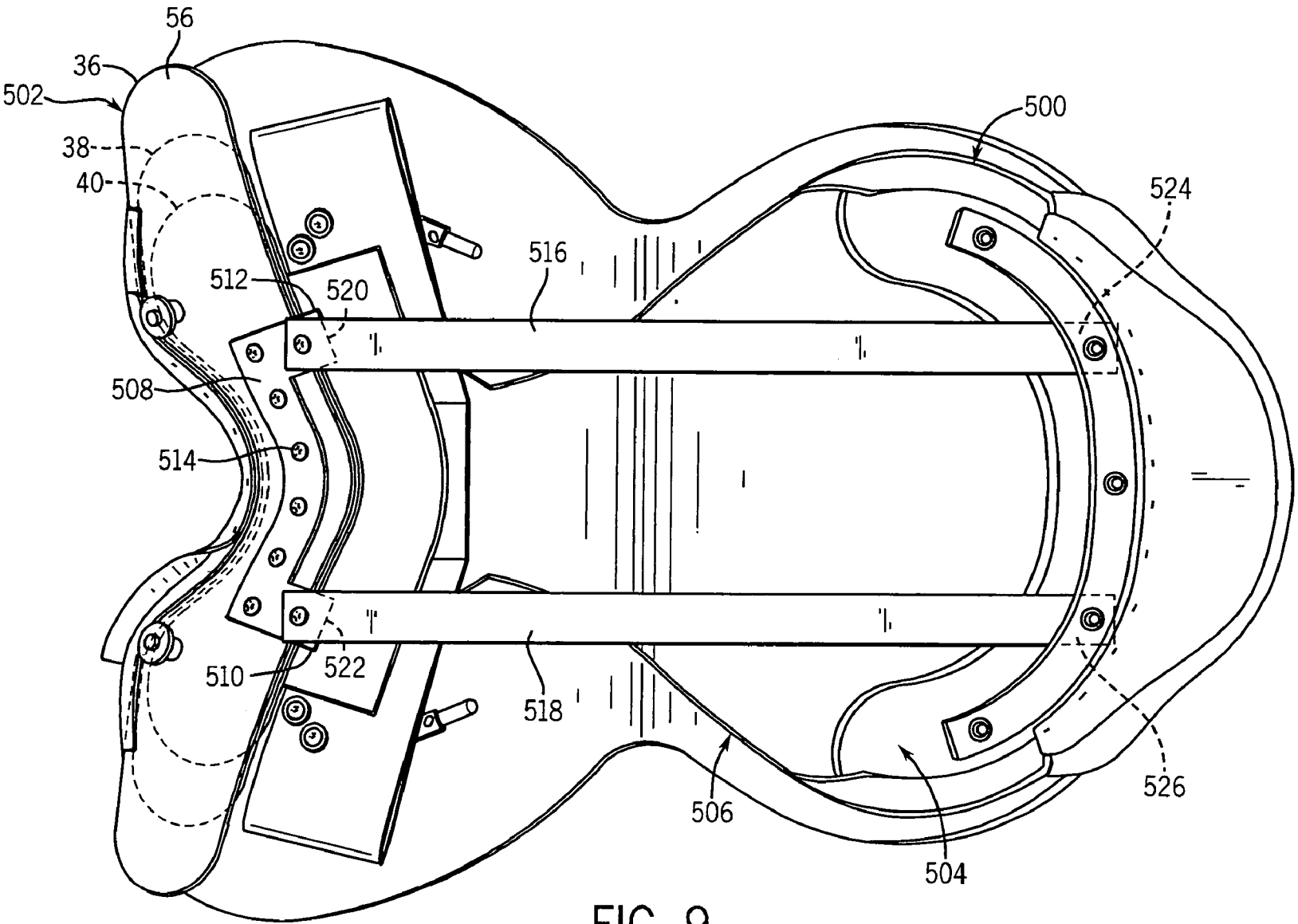
FIG. 9 is a bottom plan view of a second alternate embodiment saddle tree, illustrating connecting rails secured to a headplate centerpiece of the headplate assembly.

Further, another embodiment of the present invention is shown in FIG. 9. The saddle tree 500 of will consist of the headplate assembly 502, a cantle portion 504 and a connecting portion 506.

Layers 36, 38 and 40 of the headplate assembly 502 are arranged and configured as illustrated in FIGS. 2 and 3. However, as illustrated in FIG. 9, a headplate centerpiece 508 is provided having opposing legs 510 and 512. The headplate centerpiece 508 is provided with a plurality apertures 514 in order to secure it to the layers 36, 38 and 40 to construct the headplate assembly 500. The headplate centerpiece 508 is mounted to the bottom side 56 of the bottom layer 36 with the apertures 514 in the headplate centerpiece 504 aligned with the apertures 68 in the bottom layer 36, as shown in FIG. 9.

The saddle tree 500 is provided with connector rails 516 and 518 which extend from the headplate centerpiece 508 to the cantle portion 504. Each of the connector rails 516 and 518 has a first end 520 and 522 and a second end 524 and 526, respectively. The first end 520 of the connector rail 516 is secured to the headplate centerpiece 508 at the leg 512 and the second end 524 of the connector rail 516 is secured to the cantle portion 504. Likewise, the first end 522 of the connector rail 518 is secured to the headplate centerpiece 508 at the leg 510 and the second end 526 of the connector rail 518 is secured to the cantle portion 504.

The connector rails 516 and 518 may be secured to the headplate centerpiece 508 and the cantle 502 using screws, rivets or any securing device known to those skilled in the art. The connector rails 516 and 518 may be constructed of nylon, vinyl, polyethylene, polystyrene, polypropylene, polyvinyl chloride, or any similar flexible yet resilient material. Consistent with the broader aspects of the present invention, the connector rails 416 and 418 may be constructed of steel, or any other metal or composite material exhibiting flexibility and resilience.

Saddle tree 500, as illustrated in FIG. 9 may be completed and built up (as described in more detail herein) to form a saddle including the progressive flex saddle tree 500 and headplate assembly 502 of the present invention. Flexible connector rails 416 418 provide resilient, yet added structural strength to the saddle tree 500 which may be required in certain saddle applications, as well known to those skilled in the art.

It may therefore be appreciated from the above detailed description of the preferred embodiment of the present invention that the novel headplate assembly is constructed to provide a saddle tree and a saddle constructed therefrom having progressive flex and resistance in order to accommodate a wide variety of different sized and shaped horses with a single saddle. Further, it will be appreciated that the headplate assembly of the present invention provides a better fitting saddle tree which accounts for movement of the horse's body, and thus, minimizes soreness and injury to the horse.

Although the foregoing description of the saddle tree including the progressive flex headplate assembly of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A progressive flex headplate assembly for use in the construction of a saddle tree capable of fitting horses of different widths, said progressive flex headplate comprising:

an elongated spring element having a first end portion, a second end portion, and a center portion located therebetween, said elongated spring element having a larger thickness dimension at said center portion than at said first and second end portions, a top segment, a middle segment, and a bottom segment constructed of a flexible, resilient material, wherein said top segment has a first length dimension, said middle segment has a intermediate length dimension longer than said first length dimension of said top segment, and said bottom segment has a length dimension greater than said intermediate length dimension of said middle segment;

wherein said segments are consecutively arranged to overlie each other from said top segment to said bottom segment; and a curved segment constructed of a rigid material, said curved segment secured to said center portion of said elongated spring element;

wherein said first and said second end portions of said elongated spring element exhibit both progressive flexibility and resilience in response to flexure of said first and second end portions permitting the headplate assembly to flex to fit more than one size horse;

wherein each of said top segment, said middle segment, and said bottom segment has a front edge and a back edge, and wherein one of said top segment, said middle segment, and said bottom segment includes two rail segments extending outwardly from said back edge thereof.

2. A saddle tree for use in the construction of a progressive flex riding saddle for a horse, said saddle tree comprising:

a progressive flex headplate comprising an elongated spring element having a first end portion, a second end portion, and a center portion located therebetween, said elongated spring element having a larger thickness dimension at said center portion than at said first and second end portions; and a curved segment constructed of a rigid material, said curved segment secured to the top of said center portion of said elongated spring element;

wherein said first and said second end portions of said elongated spring element exhibit both progressive flexibility and resilience in response to flexure of said first and second end portions permitting the headplate assembly to flex to fit more than one size horse, which will be located at a position near the front of the horse when the saddle is installed thereupon;

a cantle portion which will be located at a position near the rear of the horse when the saddle is installed thereupon; and a flexible connecting portion connecting the progressive flex headplate assembly to said cantle portion.

3. A headplate assembly for use in the construction of a progressive flex saddle tree, said headplate assembly comprising:

a plurality of flexible, resilient segments positioned overlapping each other, said flexible segments forming a stack having a top side and a bottom side, said stack also having first and second legs and a central portion therebetween said central portion arranged and configured to rest upon a horse when the headplate assembly is installed on a horse, wherein each of said flexible, resilient segments includes a front edge and a back edge and wherein each of said flexible, resilient segments has a small, curved indentation formed in said front edge thereof; and a rigid, curved segment aligned with and secured to one of said top side and said bottom side of said stack at said central portion thereof; wherein said first leg will be positioned on one side of a horse's withers and said second leg will be positioned on the other side of the horse's withers when the headplate assembly is installed thereupon, and wherein each of said legs exhibits both progressive flexibility and resilience in response to flexure of said legs, thereby permitting said legs to accommodate horses having different sized withers.

4. A headplate assembly according to claim 3, wherein said plurality of flexible, resilient segments includes from about two to about five flexible, resilient segments.

5. A headplate assembly according to claim 3, wherein each of said plurality of flexible, resilient segments is constructed from nylon, vinyl, polyethylene, polystyrene, polypropylene, polyvinyl chloride, or a combination thereof.

6. A headplate assembly according to claim 3, wherein each of said plurality of flexible, resilient segments is constructed from of a metal or an alloy material.

7. A headplate assembly according to claim 3, wherein one of said flexible, resilient segments includes two connecting rails extending outwardly from said back edge thereof.

8. A headplate assembly according to claim 3, wherein said rigid, curved segment is secured to said stack using a securing mechanism.

9. A headplate assembly according to claim 8, wherein said securing mechanism comprises a plurality of rivets and washers.

10. A headplate assembly according to claim 9, wherein said securing mechanism is selected from the group consisting of tacks, nails, screws, bolts, pins, and a combination thereof.

11. A progressive flex saddle tree comprising:

the headplate assembly of claim 3;

a cantle portion located at a position which is spaced away from said headplate assembly; and a flexible connecting portion connecting said progressive flex headplate to said cantle portion.

12. A headplate assembly providing a progressive flex to a saddle tree, said headplate assembly comprising:

a top segment, a middle segment, and a bottom segment each constructed of a resilient, flexible material, each of said top segment, said middle segment, and said bottom segment having a length dimension and a midpoint portion located at substantially the midpoint of said length dimension, said length dimension of said bottom segment being longer than said length dimension of said middle segment and said length dimension of said middle segment being longer than said length dimension of said top segment, each of said top segment, said middle segment and said bottom segment having a front edge and a back edge;

wherein said top segment, said middle segment, and said bottom segment are consecutively arranged overlapping each other from said top segment to said bottom segment with said midpoint portions of each of said top segment, said middle segment, and said bottom segment being aligned and wherein one of said top segment, said middle segment and said bottom segment further comprises at least one connecting rail extending from said back edge thereof;

a rigid, curved segment overlying and secured to one of said top segment or said bottom segment at said midpoint portion thereof to thereby form a substantially V-shaped assembly;

wherein said substantially V-shaped assembly has a fixed apex portion, a first leg intended to lie on one side of a horse's withers, and a second leg intended to lie on the other side of a horse's withers, each of said legs being progressively flexible and exhibiting progressive resistance in response to flexure of each of said legs.

13. A progressive flex saddle tree for use in a riding saddle for a horse, said progressive flex saddle tree comprising:

a headplate assembly, which will be located at a position near a front portion of the horse comprising:

a top segment, a middle segment, and a bottom segment each constructed of a resilient, flexible material, each of said top segment, said middle segment, and said bottom segment having a length dimension and a midpoint portion located at substantially the midpoint of said length dimension, said length dimension of said bottom segment being longer than said length dimension of said middle segment and said length dimension of said middle segment being longer than said length dimension of said top segment;

wherein said top segment, said middle segment, and said bottom segment are consecutively arranged overlapping each other from said top segment to said bottom segment with said midpoint portions of each of said top segment, said middle segment, and said bottom segment being aligned; and a rigid, curved segment overlying and secured to one of said top segment or said bottom segment at said midpoint portion thereof to thereby form a substantially V-shaped assembly;

wherein said substantially V-shaped assembly has a fixed apex portion, a first leg intended to lie on one side of a horse's withers, and a second leg intended to lie on the other side of a horse's withers, each of said legs being progressively flexible and exhibiting progressive resistance in response to flexure of each of said legs;

a cantle portion which will be located at a position near the rear of the horse; and a flexible connecting portion connecting said progressive flex headplate and said cantle portion.

14. A progressive flex saddle used to accommodate horses of differing sizes, said progressive flex saddle comprising:

the progressive flex saddle tree of claim 13.

15. A progressive flex saddle tree for use in a riding saddle for a horse, said progressive flex saddle tree comprising:

a progressive flex headplate assembly including:

a plurality of flexible, resilient segments positioned overlapping each other, said flexible segments forming a stack having a top side, a bottom side, first and second legs and a midpoint portion located between said first and second legs; and a rigid, curved segment aligned with and secured to one of said top side and said bottom side of said stack at said midpoint portion thereof;

a cantle portion having an inverted U-shape; and a flexible connecting portion joining said progressive flex headplate assembly and said cantle portion;

wherein said first leg will be positioned on one side of a horse's withers and said second leg will be positioned on the other side of the horse's withers when the riding saddle including the saddle tree is installed thereupon, wherein each of said first and second legs exhibits both progressive flexibility and progressive resilience in response to flexure thereof, permitting said saddle tree to accommodate horses having different sized withers.

16. A progressive flex saddle tree according to claim 15, wherein said plurality of flexible, resilient segments are constructed from nylon, vinyl, polyethylene, polystyrene, polypropylene, polyvinyl chloride, or a combination thereof.

17. A progressive flex saddle tree according to claim 15, wherein said headplate comprises from two to five flexible, resilient segments.

18. A progressive flex saddle tree according to claim 15, wherein said rigid, curved segment is constructed of a metal, a wood, or a thermoplastic material.

19. A progressive flex saddle tree according to claim 15, further comprising:

at least one connecting rail formed integrally with one of said flexible, resilient segments and extending outwardly from said one of said flexible, resilient segments and engaging said cantle portion.

20. A progressive flex riding saddle comprising:

the progressive flex saddle tree of claim 15, said progressive flex saddle tree having a top portion and a bottom portion;

a seat cover for covering said top portion of said saddle tree; and a lower saddle assembly for supporting said saddle tree, said lower portion comprising first and second elongated members that will lie on either side of a horse's spine, and at least two saddle panels affixed to said elongated members;

wherein said progressive flex saddle tree is secured at said bottom portion to said lower saddle assembly.

21. A saddle tree for use in a riding saddle capable of fitting more than one size horse, said saddle tree comprising:

a top segment, a middle segment, and a bottom segment each constructed of a resilient, flexible material, each of said top segment, said middle segment, and said bottom segment having a length dimension and a midpoint portion located at substantially the midpoint of said length dimension, said length dimension of said bottom segment being longer than said length dimension of said middle segment and said length dimension of said middle segment being longer than said length dimension of said top segment;

wherein said top, middle and bottom segments are consecutively arranged overlapping each other from said top segment to said bottom segment with each of said midpoint portions being aligned; and a rigid, curved segment overlaying and affixed to one of said top segment and said bottom segment at said midpoint portion thereof; wherein said segments and said rigid curved segment form a substantially V-shaped headplate assembly having a fixed apex portion and a first leg intended to lie on one side of a horse's withers, and a second leg intended to lie on another side of the horse's withers, each of said first and second legs being progressively flexible and also exhibiting resilience in response to flexure of said first and second legs;

a cantle portion having an inverted U-shape, said cantle portion having a top side projecting upwardly to form a seat back for a saddle, said cantle having a substantially flat bottom side; and a connecting portion joining said substantially V-shaped headplate assembly and said cantle portion.

22. A progressive flex saddle tree according to claim 21, wherein said top segment, said middle segment, and said bottom segment are each constructed from nylon, vinyl, polyethylene, polystyrene, polypropylene, polyvinyl chloride, or a combination thereof.

23. A progressive flex saddle tree according to claim 21, wherein said rigid curved segment is constructed of a rigid material selected from metal, plastic, wood, or combinations thereof.

24. A progressive flex saddle tree according to claim 21, wherein said connecting portion is substantially flat and is constructed of a flexible material selected from leather, nylon, woven fabric, or nonwoven fabric.

25. A saddle tree according to claim 21, further comprising:

at least one connecting rail extending outwardly from one of said top segment, said middle segment, and said bottom segment at a position adjacent said midpoint portion thereof;

wherein said connecting rail joins said headplate assembly to said cantle portion.

26. A riding saddle capable of fitting more than one horse, said riding saddle comprising a progressive flex saddle tree, said saddle tree comprising:

a headplate assembly which will be located at the front of the horse when the riding saddle is installed thereupon, said headplate assembly including an elongated spring element having a first end portion, a second end portion, and a center portion located therebetween, said elongated spring element having a larger thickness dimension at said center portion than at said first and second end portions, and a curved segment constructed of a rigid material, said curved segment secured to the top of said said center portion of said elongated spring element;

wherein said first and said second end portions of said elongated spring element exhibit both progressive flexibility and progressive resilience in response to flexure of said first and second end portions, thereby permitting the headplate assembly to flex to fit more than one size horse;

a cantle portion having an inverted U-shape located at the rear of the horse when the saddle is installed thereupon; and a flexible connecting portion joining said headplate assembly to said cantle portion.

* * * * *